US007608846B2

(12) United States Patent
Nakano

(10) Patent No.: US 7,608,846 B2
(45) Date of Patent: Oct. 27, 2009

(54) EXTREME ULTRA VIOLET LIGHT SOURCE DEVICE

(75) Inventor: Masaki Nakano, Yokohama (JP)

(73) Assignees: Komatsu Ltd., Tokyo (JP); Gigaphoton Inc., Tokyo (JP)

( * ) Notice: Subject to any disclaimer, the term of this patent is extended or adjusted under 35 U.S.C. 154(b) by 338 days.

(21) Appl. No.: 11/655,109

(22) Filed: Jan. 19, 2007

(65) Prior Publication Data

US 2007/0170377 A1 Jul. 26, 2007

(30) Foreign Application Priority Data

Jan. 24, 2006 (JP) ..... 2006-015410

(51) Int. Cl.
*H05H 1/00* (2006.01)

(52) U.S. Cl. ..... 250/504 R; 250/493.1; 250/503.1

(58) Field of Classification Search ..... 250/493.1, 250/503.1, 504 R, 372
See application file for complete search history.

(56) References Cited

U.S. PATENT DOCUMENTS

| | | | | |
|---|---|---|---|---|
| 4,866,517 | A * | 9/1989 | Mochizuki et al. | 378/119 |
| 4,969,169 | A * | 11/1990 | Forsyth | 378/34 |
| 6,792,076 | B2 * | 9/2004 | Petach et al. | 378/119 |
| 6,973,164 | B2 * | 12/2005 | Hartlove et al. | 378/119 |
| 7,405,416 | B2 * | 7/2008 | Algots et al. | 250/493.1 |
| 2003/0047441 | A1 * | 3/2003 | Hensley et al. | 204/164 |
| 2004/0195529 | A1 * | 10/2004 | Hergenhan et al. | 250/504 R |
| 2005/0115361 | A1 * | 6/2005 | Forbes Jones et al. | 75/336 |
| 2005/0186716 | A1 * | 8/2005 | Kasumi | 438/149 |
| 2006/0017026 | A1 * | 1/2006 | Hergenhan et al. | 250/504 R |
| 2006/0203965 | A1 * | 9/2006 | Zink | 378/119 |
| 2007/0001131 | A1 * | 1/2007 | Ershov et al. | 250/503.1 |

FOREIGN PATENT DOCUMENTS

| | | |
|---|---|---|
| JP | 2003-518731 | 6/2003 |
| JP | 2004-031342 | 1/2004 |
| WO | 01/49087 | 7/2001 |
| WO | WO2004100621 | * 11/2004 |

* cited by examiner

*Primary Examiner*—Jack I Berman
*Assistant Examiner*—Nicole Ippolito Rausch
(74) *Attorney, Agent, or Firm*—Wenderoth, Lind & Ponack L.L.P.

(57) ABSTRACT

An EUV (extreme ultra violet) light source device in which a degree of vacuum or cleanness in a plasma generation chamber is improved while the construction is simplified. The device includes a first chamber; a second chamber connected to the first chamber through an opening portion; a target supplier that supplies a target material into the first chamber; a droplet generating unit that generates droplets of the target material of molten metal repetitively dropping based on the target material supplied by the target supplier; a blocking unit that prevents the droplets of the target material generated by the droplet generating unit from passing through the opening portion; control unit that controls the blocking unit to operate at predetermined timing; a laser light source; and an optical system that leads a laser beam to the droplets of the target material introduced into the second chamber.

24 Claims, 33 Drawing Sheets

EXTREME ULTRA VIOLET LIGHT SOURCE DEVICE

BACKGROUND OF THE INVENTION

1. Field of the Invention

The present invention relates to an EUV (extreme ultra violet) light source device for generating extreme ultra violet light by irradiating a target with a laser beam.

2. Description of a Related Art

As semiconductor processes become finer, photolithography has been making rapid progress toward finer fabrication, and, in the next generation, microfabrication of 100 nm to 70 nm, further, microfabrication of 50 nm or less will be required. For example, in order to fulfill the requirement for microfabrication of 50 nm or less, the development of exposure equipment with a combination of an EUV light source of about 13 nm in wavelength and a reduced projection reflective optics is expected.

As the EUV light source, there are three kinds of light sources which include an LPP (laser produced plasma) type using plasma generated by irradiating a target with a laser beam, a DPP (discharge produced plasma) type using plasma generated by discharge, and an SR (synchrotron radiation) type using orbital radiation. Among them, the LPP light source has advantages that extremely high intensity near black body radiation can be obtained because plasma density can be made considerably high, that the light emission of only the necessary waveband can be performed by selecting the target material, and that an extremely large collection solid angle of $2\pi$ sterad can be ensured because the light source is a point light source having substantially isotropic angle distribution and there is no structure such as electrodes surrounding the light source. Accordingly, the LPP type EUV light source device is thought to be predominant as a light source for EUV lithography, which requires a power of several tens of watts.

FIG. 31 is a schematic diagram showing the structure of a general LPP type EUV light source device. The EUV light source device includes a plasma generation chamber 2 with a nozzle 1, a laser light source 3, an optical propagation system for guiding a laser beam to the plasma generation chamber 2 (e.g. a lens 4), and a vacuum pump 5. Hereinafter, the lens 4 is used as an example of the optical propagation system in the explanation.

The nozzle 1 forms a target jet passing through a laser irradiation point by injecting a liquid or gas target material with pressure. In the case where a material such as xenon (Xe), which is in a gas state at a room temperature, is used as the target material, there may be provided upstream of the nozzle a mechanism for turning the target material into a liquid state by cooling the target material with pressure. On the other hand, in the case where a material such as stannum (Sn) or lithium (Li) which is in a solid state at room temperature is used as the target material, there may be provided upstream of the nozzle a mechanism for turning the target material into a liquid state by heating the target material beyond the melting temperature.

Further, by providing piezoelectric element 6 to the nozzle 1 to inject the target material in a liquid state while vibrating the nozzle 1, liquid drops of the target material, that is, droplets 8 can be generated. According to Rayleigh's theory of stability in minute disturbance, when disturbing a target jet having a diameter "d" flowing at a velocity "v" by adding vibration having a frequency "f", in the case where a wavelength $\lambda(\lambda=v/f)$ of the vibration generated in the target jet meets a predetermined condition (for example, $\lambda/d=4.51$), droplets 8 having a uniform size are repetitively generated at the frequency "f". The frequency at that time is called Rayleigh's frequency.

The laser light source 3 outputs a laser beam at a predetermined repetitive operation frequency. A laser beam output from the laser light source 3 is collected to a laser irradiation point 7 through a lens 4 and irradiates the target jet or droplets. Thereby, the target material is turned into a plasma state to emit the EUV light. In FIG. 31, there are shown marks of droplets 8*a*, which have been irradiated with a laser beam and turned into a plasma state. The EUV light thus generated is collected by the collector mirror having a curved surface on which Mo/Si films are formed for reflecting a light beam having a wavelength of 13 nm to 14 nm at a high reflection rate in the case of exposing a semiconductor device, and the collected EUV light is guided into an exposure device by means of a reflection mirror optical system. Since the EUV light is largely absorbed by a material or largely interacted with a material, a reflection type system is used as an optical system for guiding the EUV light to the exposure device and an optical projection system inside the exposure device.

The vacuum pump 5 exhausts inside of the plasma generation chamber 2 to keep the desired pressure and eject unwanted material such as an evaporation gas 9 of the target material. In order to prevent the gasified target material from absorbing the EUV light and preventing contamination of the optical system such as a mirror, a degree of vacuum of about 0.1 Pa is required when xenon is used as the target material.

Generally, a frequency "f" of the vibration is added to nozzle 1 to form a uniform size of droplets can be several times to several tens of times the repetitive operation frequency of outputting an irradiation laser beam. For example, the repetitive operation frequency of a YAG laser generally used in the LPP type EUV light source is about 10 kHz, while a frequency "f" for generating droplets by vibration is about 110 kHz in the case of forming droplets having a diameter of about 60 μm dropping at a velocity of about 30 m/s. Therefore, most of the generated droplets pass through the laser irradiation point 7 without being irradiated with a laser beam. Such droplets (remaining target material) 10 are exhausted to the outside of the plasma generation chamber 2 by the vacuum pump 5. However, in the case where only the vacuum pump 5 is provided to the plasma generation chamber 2, it is difficult to keep inside of the plasma generation chamber 2 at a high degree of vacuum. As a result, the generated EUV light is apt to be absorbed to the target material gasified in the plasma generation chamber 2, which reduces output of the EUV light. Especially, the EUV light having a wavelength of 13.5 nm to be used for EUV photolithography is easily absorbed by xenon gas, and therefore, the EUV generation efficiency is decreased.

As related art, Japanese Patent Application Publication JP-P2004-31342A discloses a laser plasma EUV radiation source preventing succeeding target droplets from being affected by ionized preceding droplets. A source nozzle of the EUV radiation source has an orifice with a predetermined dimension capable of ejecting droplets at a rate set by a natural Rayleigh unstable destructive frequency. The target material generated by a piezoelectric transducer. A droplet generation rate is decided by factors in relation to a pulse frequency from an exciting laser such that buffer droplets are applied between target droplets. The buffer droplets act for absorbing radiation from the ionized target droplet so as not to affect the succeeding target droplets. However, even if the buffer droplets absorb radiation from the ionized target droplet, a degree of vacuum or cleanness in the plasma generation chamber is decreased due to the buffer droplets, which causes reduced output of the EUV light.

Further, Japanese Patent Application Publication JP-P2003-518731A (WO01/049087) discloses providing a vacuum space (collecting chamber) for collecting unwanted target material droplets to an EUV light source device as shown in FIG. 31. That is, as shown in FIG. 32, the collecting chamber 11 provided with vacuum pump 12 is provided downstream of the plasma generation chamber 2. The collecting chamber 11 is connected to a plasma generation chamber 2 through a constriction part (e.g. skimmer or orifice) 13 having a opening portion 13*a*. Thereby, from among the droplets injected from the nozzle 1, droplets 10, which have not been irradiated with a laser beam and have not contribute to generation of plasma, are collected in the collecting chamber 11 through the opening portion 13*a*, and ejected outside by the vacuum pump 12. By properly determining a diameter of the opening portion 13*a*, an exhausting amount of the vacuum pump 12 and so on, a high degree of vacuum and cleanness in the plasma generation chamber 2 can be kept more easily than the EUV light source device as shown in FIG. 31. Further, by providing two vacuum pumps in total, a burden of each vacuum pump is reduced and a size of each vacuum pump can be reduced.

However, also in the EUV light source device as shown in FIG. 32, the target material always evaporates from a surface of the droplets 8 since droplets 8 are injected from the nozzle 1 until droplets 8 pass through the constriction part 13. Further, energy of an irradiation laser beam is very high. Therefore, several droplets preceding or succeeding the droplet to be irradiated with the laser beam are influenced by deformation or position change due to the impact of an irradiation laser, and at worst, evaporated by heat. Accordingly, not all of the droplets which have not been irradiated with a laser beam are collected to the collecting chamber 11. Such an evaporation gas or droplets not collected should be exhausted by the vacuum pump 5 provided in the plasma generation chamber 2. For that reason, it is difficult to lower a degree of vacuum to a required level (e.g. about 0.1 Pa in the case of employing xenon as a target material) in the plasma generation chamber 2. As a result, also in the EUV light source device, a degree of vacuum in the plasma generation chamber 2 cannot be kept at a high degree of vacuum, and the generated EUV light is absorbed, which causes reduced output of the EUV light.

In this regard, JP-P2003-518731A also discloses that a second vacuum space (collecting chamber) provided to the EUV light source device shown in FIG. 32. As shown in FIG. 33, the second collecting chamber 14 provided with the vacuum pump 15 is arranged at upstream of the plasma generation chamber 2. The collecting chamber 14 and the plasma generation chamber 2 are connected to each other through an opening portion 16*a* formed in a constriction part 16. Thereby, evaporation gas generated from droplets 8 injected from the nozzle 1 is exhausted to the outside by the vacuum pump 15, and therefore, a degree of vacuum or cleanness in the plasma generation chamber 2 can be kept higher than that of the EUV light source device as shown in FIG. 32.

However, in the plasma generation chamber 2, there are still droplets 10 not irradiated with a laser beam remaining. Such droplets are affected by adjacent droplets to be deformed or changed in a position due to impact of laser irradiation to the adjacent droplets, and at worst, evaporated by heat.

Thus, unexpected evaporation or the like occurs in the plasma generation chamber 2, and therefore, not all of the unwanted droplets are collected into the collecting chamber 11. Therefore, it is also difficult to keep the pressure at a high degree of vacuum in the plasma generation chamber 2 or to protect components such as a mirror in the chamber from the gasified target material. Further, three chambers and three vacuum pumps become required, which makes the system large and complicated.

The above-mentioned influence of the target turned into plasma affecting the adjacent targets becomes problem not only in the case where the target material is in a gas state at a room temperature, for example, xenon, but also in the case where the target material is in a solid state or a liquid state including a solid at a room temperature, for example, molten metal of stannum or lithium, a mixture in which minute metal particles of stannum, stannum oxide, copper or the like are dispersed into water or alcohol, or an ionic solution in which lithium fluoride or lithium chloride is dissolved into water. Those target materials may evaporate as a result of being affected by the heat of the plasma, and once gasified, metal particles contaminate components such as a mirror in the chamber, further degrading the performance of the EUV light source device.

SUMMARY OF THE INVENTION

The present invention has been achieved in view of the above-mentioned problems. An object of the present invention is to improve a degree of vacuum or cleanness in a plasma generation chamber in an EUV light source device while the construction is simplified.

In order to achieve the above object, an extreme ultra violet light source device according to one aspect of the present invention is an extreme ultra violet light source device for generating extreme ultra violet light by irradiating a target material with a laser beam emitted from a laser light source to turn the target material into a plasma state, and the device comprises: a first chamber; a second chamber connected to the first chamber through an opening portion; a target supplier that supplies a target material into the first chamber; droplet generating means provided in the first chamber, the droplet generating means generating droplets of the target material of molten metal repetitively dropping based on the target material supplied by the target supplier; blocking means that prevents the droplets of the target material generated by the droplet generating means from passing through the opening portion; control means that controls the blocking means to operate at predetermined timing; a laser light source that generates a laser beam; and an optical system that leads the laser beam generated by the laser light source to the droplets of the target material generated in the first chamber and introduced into the second chamber through the opening portion.

According to the present invention, by blocking droplets, which are not irradiated with a laser beam, from among the generated droplets, excessive droplets are prevented from being introduced into the second chamber, and therefore, a degree of vacuum or cleanness in the second chamber can be kept high with an economical and simple structure. As a result, generation efficiency of extreme ultra violet light emitted from the target material can be improved economically.

DESCRIPTION OF THE PREFERRED EMBODIMENTS

Figure 1:
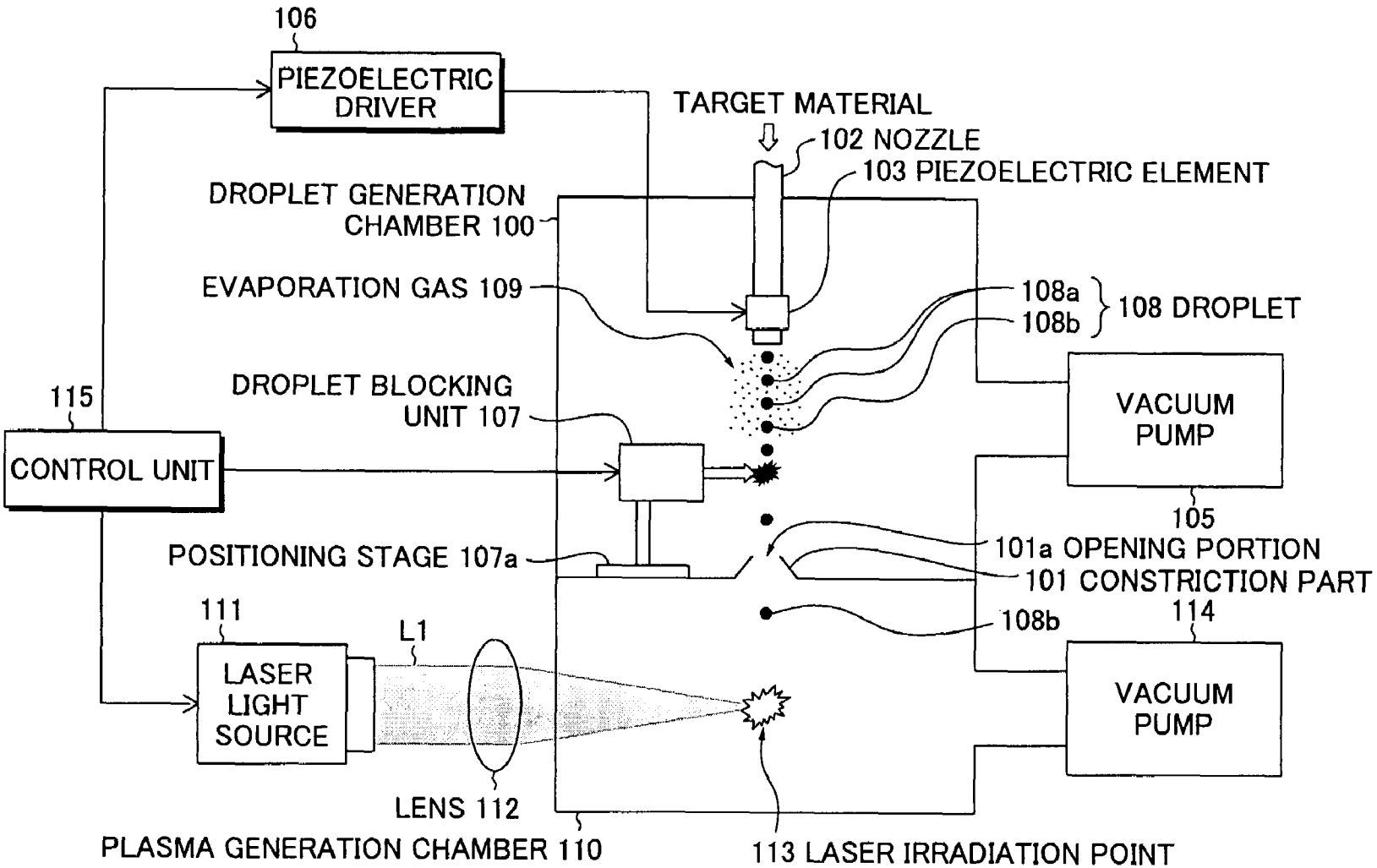
FIG. 1 is a schematic diagram for explaining principle of an EUV light source device according to the present invention.

Hereinafter, preferred embodiments of the present invention will be described in detail by referring to the drawings. The same reference numerals are assigned to the same component elements and the repetitive description thereof will be omitted.

FIG. 1 is a diagram for explaining the principle of the present invention, and schematically showing a part of an EUV (extreme ultra violet) light source device. The EUV light source device is an LPP (laser produced plasma) type, and includes a droplet generation chamber 100, a piezoelectric driver 106, a plasma generation chamber 110 in which plasma is generated in order to generate EUV light, a laser light source 111 which generates a laser beam for irradiating droplets of a target material in a plasma generation chamber 110, a lens 112 for leading a laser beam L1 generated by a laser light source 111 to a laser irradiation point 113, and a control unit 115. The droplet generation chamber 100 and the plasma generation chamber 110 are connected to each other through an opening portion 101*a*.

The droplet generation chamber 100 is provided with a nozzle 102 with a piezoelectric element 103, and the vacuum pump 105. Further, to the piezoelectric element 103, there is connected a piezoelectric driver 106 for generating a drive signal to be supplied to the piezoelectric element 103. Furthermore, a droplet blocking unit 107 for blocking dropping droplets is arranged inside the droplet generation chamber 100.

The nozzle 102 injects the target material supplied from outside into the droplet generation chamber 100. As the target material, molten metal such as melted stannum, lithium or the like, mixture in which minute metal particles of stannum, stannum oxide, copper or the like are dispersed into water or alcohol, or ionic solution in which lithium fluoride (LiF) or lithium chloride (LiCl) is dissolved into water can be used. Although explanation will be made in the case where molten stannum is used as the target material in the embodiment, the present invention improves a degree of vacuum or cleanness in the chamber in the case where other materials are used as the target material.

The piezoelectric element 103 provides vibration having a predetermined frequency "f" to the nozzle 102 by expanding and contracting based on the drive signal supplied by the piezoelectric driver 106. Thus, by disturbing, through the nozzle 102, a flow of the target material (target jet) injected from the nozzle 102, the repetitively dropping droplets 108 of the target material can be generated. Here, supposing that a velocity of a target jet is "v", a wavelength of the vibration generated in the target jet is "λ" (λ=v/f), and a diameter of the target jet is "d", in the case a predetermined condition (for example, λd=4.51) is satisfied, a desired uniform size of droplets can be generated. This frequency of disturbance to be generated in the target jet is called a Rayleigh frequency. Actually, in the case where λ/d is in a range from about 3 to about 8, droplets having a uniform size can be generated. Since the velocity "v" of the target jet injected from the nozzle generally used in the EUV light source device is about 20 m/s to 30 m/s, a frequency of the vibration to be provided to the nozzle becomes several tens kHz to several hundreds kHz in the case of generating droplets having a diameter of about 10 μm to 100 μm. Hereinafter, a number of droplets thus generated in one second is called droplet generation frequency, or simply called generation frequency.

The vacuum pump 105 keeps a desired degree of vacuum in the droplet generation chamber 100, and exhausts an evaporation gas 109 generated from a surface of the generated droplets 108 and the unwanted target material, which will be described later.

The droplet blocking unit 107 operates at predetermined timing under the control of the control unit 115 to break the dropping droplet 108 or change the orbit thereof, or blocking the opening portion 101*a* from the droplet 108, thereby preventing predetermined droplets from passing through the opening portion 101*a*.

The droplets to be blocked by the droplet blocking unit 107 is selected in the following way. As explained above, the generation frequency of droplets 108 is about several tens kHz to several hundreds kHz, while the repetitive operation frequency required for a general EUV light source is about 10 kHz. Therefore, the droplets 108 are thinned out such that the timing when droplets 108 pass through the laser irradiation point 113 is coincident with the repetitive operation of the laser light source. For example, in the case where the generation frequency of droplets 108 is 100 kHz and repetitive operation frequency of the laser light source is 10 kHz, droplets 108 may be thinned out by a ratio of 1/10. That is, the operation is repeated in which nine droplets are sequentially blocked and then one droplet is allowed to pass through. FIG. 1 shows droplets 108*a* to be blocked by the droplet blocking unit 107 and droplets 108*b* to be allowed to pass through the opening portion 101*a*.

As shown in FIG. 1, positioning stage 107*a* may be provided to the droplet blocking unit 107. Since a diameter of the droplets 108 is generally small, about 10 μm to 100 μm, it is necessary to adjust distance or positioning relationship between the droplet blocking unit 107 and the droplets 108. The positioning stage 107*a* finely adjusts a position of the droplet blocking unit 107 on the X, Y and Z directions under control from outside of the chamber by employing a remote control device or the like.

A vacuum pump 114 is provided in the plasma generation chamber 110. The vacuum pump 114 exhausts unwanted material such as evaporated gas generated from a surface of the droplets 108*b* introduced to the plasma generation chamber 110 through the opening portion 101*a* and so on to keep the desired degree of vacuum in the plasma generation chamber 110.

The laser beam L1 emitted from the laser light source 111 is collected by the lens 112 to irradiate the laser irradiation point 113 within the plasma generation chamber 110 at a predetermined repetitive operation frequency, for example, 10 kHz. In the plasma generation chamber 110, droplets 108*b* after thinning out at a predetermined interval are irradiated with the laser beam L1 when passing through the laser irradiation point 113, and the target material is turned into a plasma state to generate the EUV light. Thus generated EUV light is led to the exposure device or the like through a reflection optical system formed with Mo/Si films for example.

The control unit 115 sets the droplet generation frequency in the piezoelectric driver 106 according to a diameter of the nozzle 102, a jet velocity of the target material and so on, and controls the operation timing of the droplet blocking unit 107 according to the set droplet generation frequency and the repetitive operation frequency of the laser light source 111.

Figure 2:
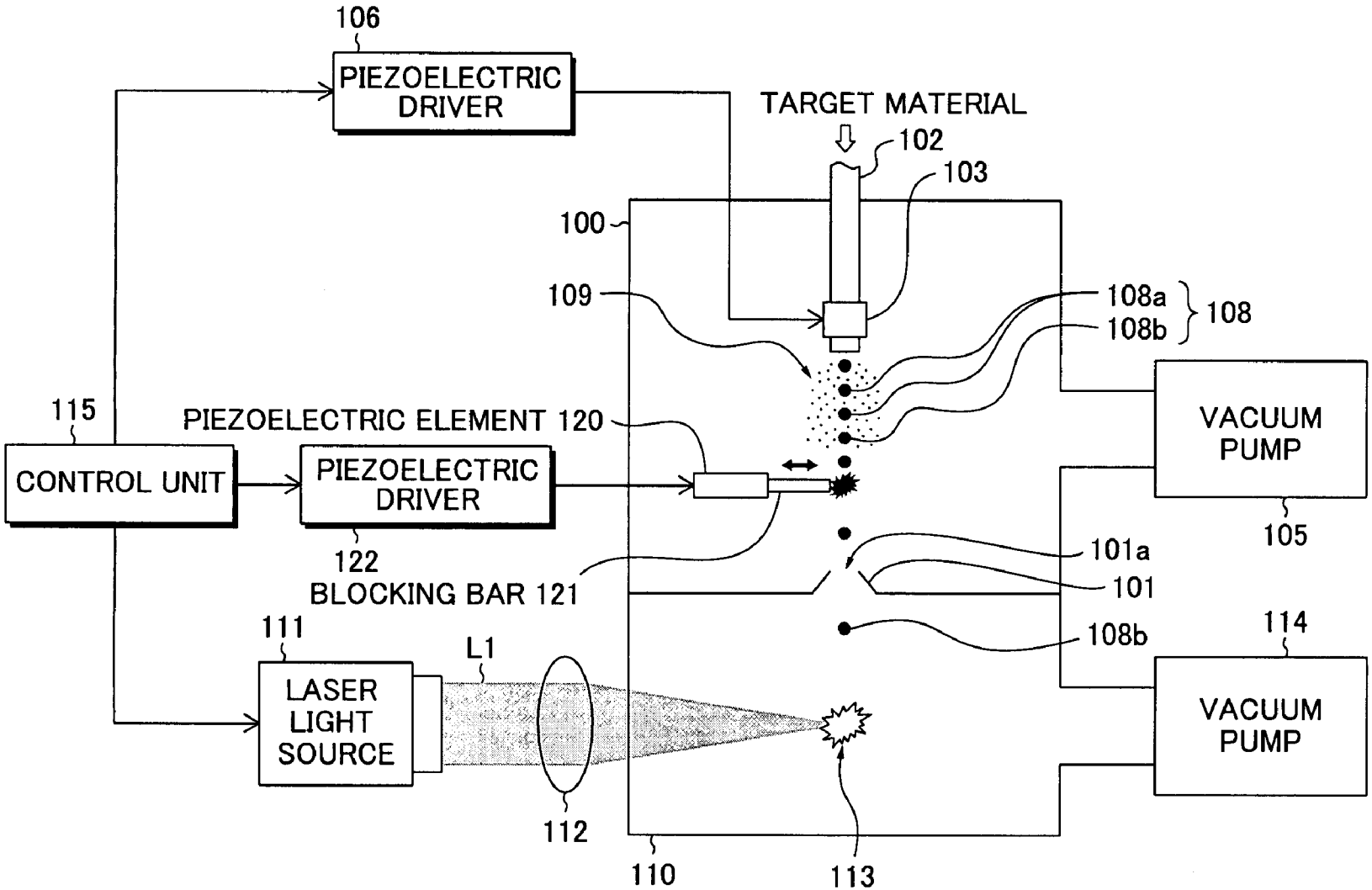
FIG. 2 is a schematic diagram showing a structure of the EUV light source device according to the first embodiment of the present invention.

FIG. 2 is a schematic diagram showing a structure of the EUV light source device according to the first embodiment of the present invention. In the EUV light source device, the droplet blocking unit 107 as shown in FIG. 1 is constructed by employing a piezoelectric element. Other components are the same as those in the EUV light source device as shown in FIG. 1.

As shown in FIG. 2, the EUV light source device includes a piezoelectric element 120 provided with a blocking bar 121, a piezoelectric driver 122 for generating a drive signal to be provided to the piezoelectric element 120. In this embodiment, a piezoelectric element of an actuator type is used. Generally, a piezoelectric element of an actuator type is an element for expanding and contracting on the direction according to polarity of applied voltage, and characterized by quick time response to a drive signal. The piezoelectric driver 122 generates a drive signal at a predetermined time interval for expanding or contracting the piezoelectric element 120 under control of the control unit 115. A position and a length of the blocking bar 121 against the piezoelectric element 120 is adjusted such that the blocking bar 121 reaches an orbit of the droplets 108 when the piezoelectric element 120 expands and the blocking bar 121 moves to a position out of the orbit of droplets 108 when the piezoelectric element 120 contracts.

In order to thin out the generated droplets 108, two methods described below can be used specifically. In a first method, each time the droplets 108*a* not to be irradiated with a laser beam are about to pass through at the height of the blocking bar 121 (in the case where the target advances from top to bottom is shown as an example, which applies hereinafter), the piezoelectric element 120 is caused to expand, and by sticking the droplets 108*a* with the blocking bar 121, the droplets 108*a* are broken or the orbit of the droplets 10*a* is changed. On the contrary, when the droplets 108*b* to be irradiated with a laser beam are about to pass through at the height of the blocking bar 121, the piezoelectric element 120 is not driven. Thereby, it is possible to cause only the droplets 108*b* to pass through the opening portion 101*a*. In a second method, while the droplets 108*a* are dropping, the piezoelectric element 120 is caused to expand, and by inserting the blocking bar 121 into the orbit of the droplets 108*a*, the opening portion 101*a* is blocked from the droplets 108*a*. Then, only when the droplets 108*b* are about to pass through at the height of the blocking bar 121, the piezoelectric element 120 is caused to contract to cause the droplets 108*b* to pass through the opening portion 101*a*.

When the above-mentioned second method is used, it is required to adjust the drive frequency of the piezoelectric element 120 to the repetitive operation frequency (for example, 10 kHz) of the laser light source 111, not to the generation frequency (for example, 100 kHz) of the droplet 108. As a result, the power consumed to drive the piezoelectric element 120 can be reduced and the life of the piezoelectric element 120 can be lengthened, and therefore, is it possible to improve the reliability of the EUV light source device shown in FIG. 2.

Figure 3:
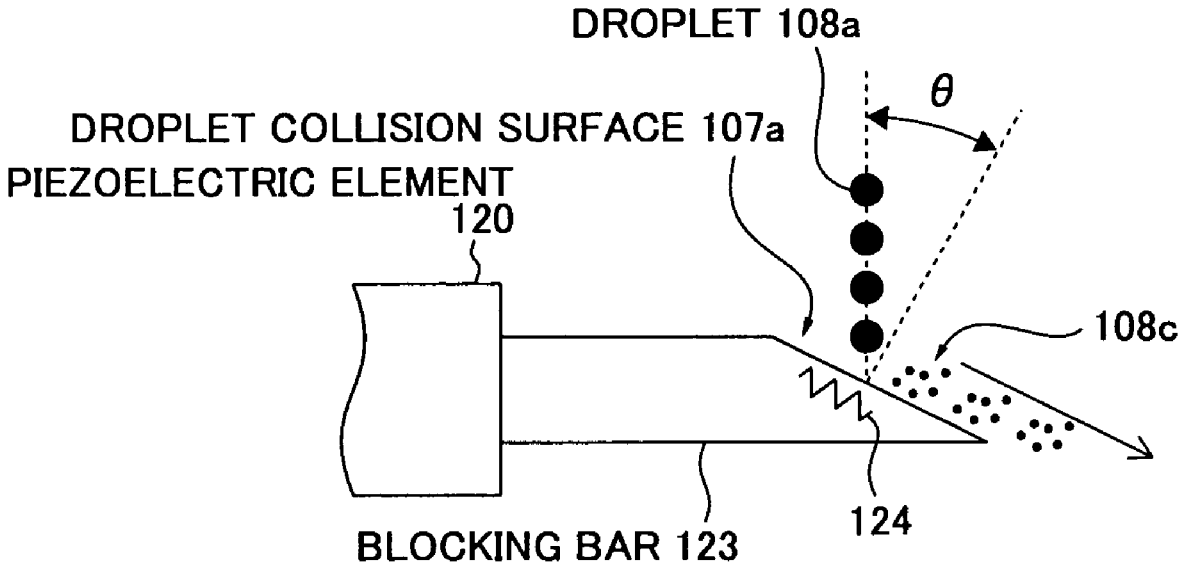
FIG. 3 is a diagram for explaining a variation of the EUV light source device as shown in FIG. 2.

FIG. 3 is a diagram for explaining a variation of the EUV light source device as shown in FIG. 2. In the present embodiment, it is possible to add various effects by modifying the shape and structure of the blocking bar 121 shown in FIG. 2. For example, a blocking bar 123 shown in FIG. 3 may be used instead of the blocking bar 121 shown in FIG. 2. A droplet collision surface 123*a* of the blocking bar 123 is formed such that the normal line forms angle θ with the orbit of the droplets 108. In this manner, by forming an inclination at the tip of the blocking bar 123, it is possible to cause the droplets 108*a* which have collided with the droplet collision surface 123*a* and/or its remains 108*c* to flow along the inclination. Thereby, it is no longer likely that the remains 108*c* stay on the blocking bar 123 or that the remains 108*c*, if staying, will solidify, and therefore, it is possible to prevent the operation efficiency of the blocking bar 123 from decreasing. In addition, a heater 124 may be provided at the tip of the blocking bar or near the droplet collision surface 123*a*. It is possible to prevent the remains 108*c* of the droplets 108*a* from solidifying to accumulate on the blocking bar by heating the area in which the droplets 108*a* collide.

Figure 4:
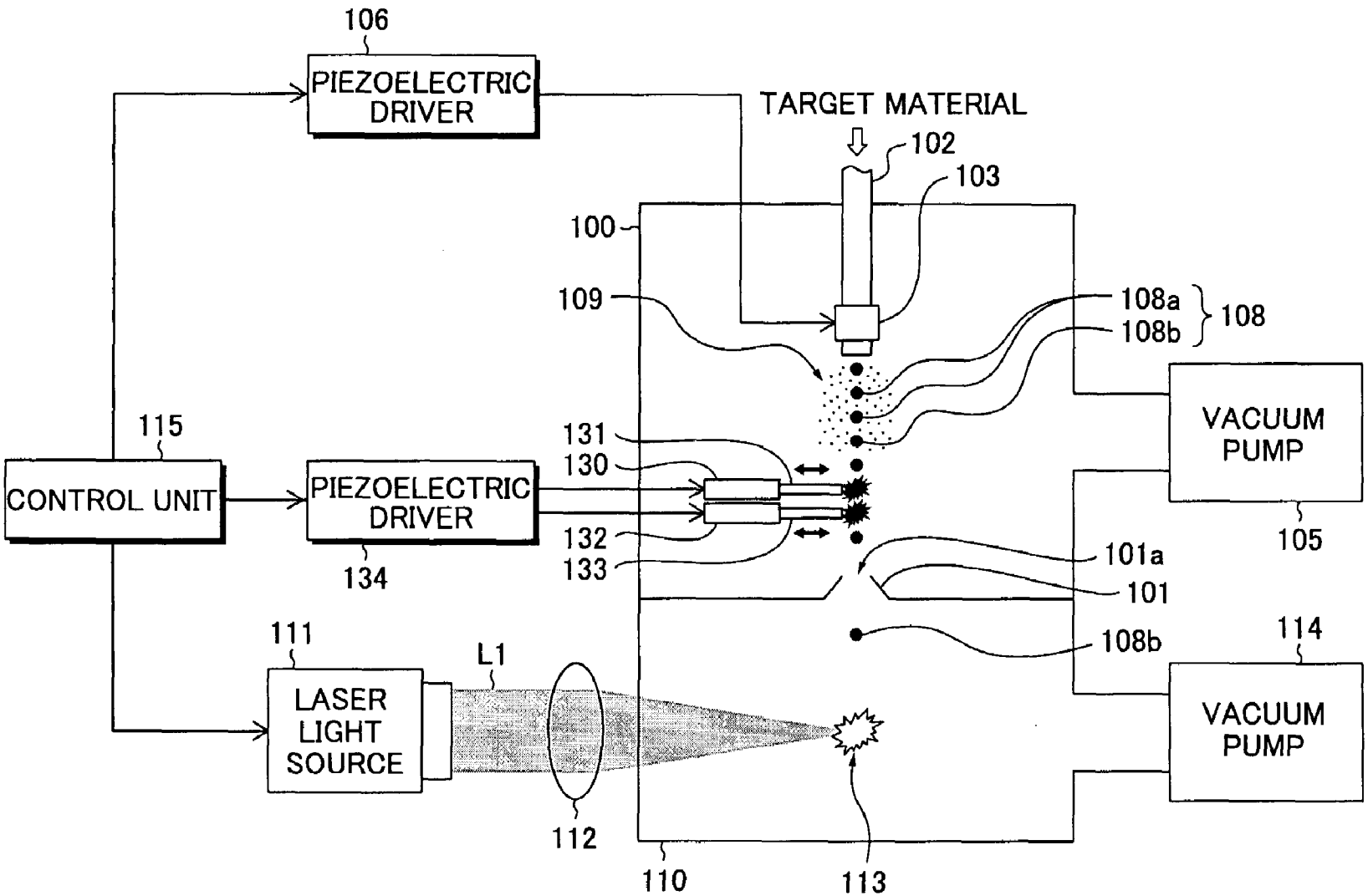
FIG. 4 is a schematic diagram showing a structure of the EUV light source device according to the second embodiment of the present invention.

FIG. 4 is a schematic diagram showing the structure of the EUV light source device according to the second embodiment of the present invention. In the EUV light source device, the droplet blocking unit 107 shown in FIG. 1 employs a structure in which a plurality of piezoelectric elements are used. Incidentally, in FIG. 4, an example in which two piezoelectric elements are used is shown, however, it may also be possible to use three or more piezoelectric elements. Other structures are the same as the EUV light source device shown in FIG. 1.

As shown in FIG. 4, the EUV light source device includes a piezoelectric element 130 of an actuator type provided with a blocking bar 131, a piezoelectric element 132 of an actuator type provided with a blocking bar 133, and a piezoelectric driver 134 for generating a drive signal to be supplied to the piezoelectric elements 130 and 132, respectively. The position and length of the blocking bars 131 and 133 in the piezoelectric elements 130 and 132 are adjusted such that the blocking bars 131 and 133 reach the orbit of the droplets 108 when the piezoelectric element expands and the blocking bars 131 and 133 move to a position out of the orbit of the droplets 108 when the piezoelectric element contracts.

The piezoelectric driver 134 supplies the drive signal simultaneously or alternately to the piezoelectric elements 130 and 132 under the control of the control unit 115. Thereby, the blocking bars 131 and 133 break the droplet 108*a* simultaneously or alternately, or change the orbit (i.e. path or route) thereof, or block the opening portion 101*a* from the droplet 108*a*. In this manner, by using a plurality of piezoelectric elements, it is possible to reduce the drive frequency of each piezoelectric element compared to the case where only one piezoelectric element is used. For example, as shown in FIG. 4, when two piezoelectric elements are used, the drive frequency becomes ½, and when three piezoelectric elements are used, the drive frequency becomes ⅓. Therefore, it is possible to reduce the burden on each piezoelectric element and to lengthen its life.

Also in the present embodiment, similar to that shown in FIG. 3, it may be possible to form an inclination at the tip of the blocking bars 131 and 133, or provide a heater.

In the first and second embodiments of the present invention explained above, the blocking bar is attached to the piezoelectric element, however, it may also be possible to attach a plate-shaped blocking member (blocking plate) to the piezoelectric element instead of the bar. In this case, it is possible to relax the position adjustment of the blocking plate with respect to the orbit of the droplets.

Figure 5:
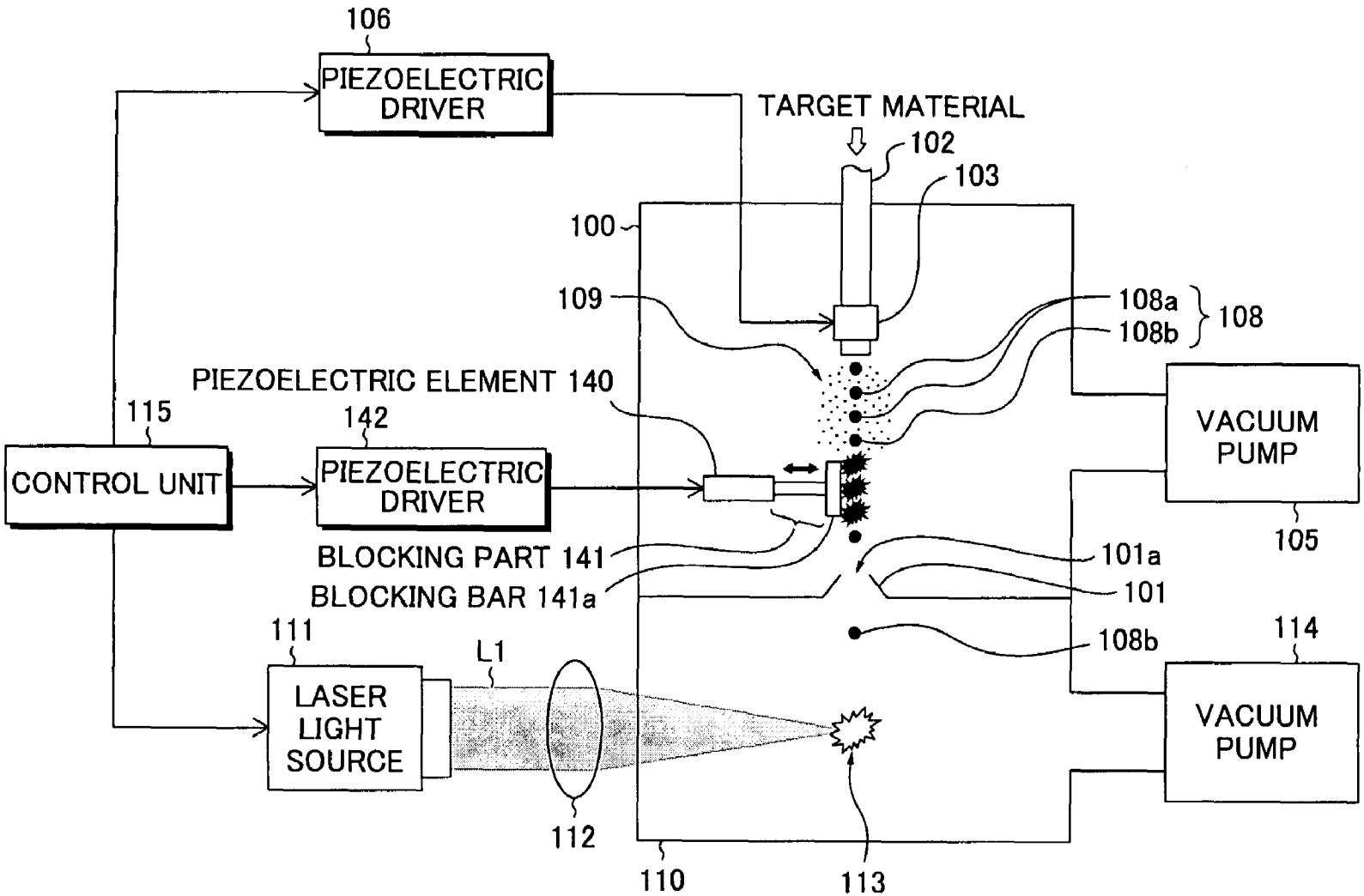
FIG. 5 is a schematic diagram showing a structure of the EUV light source device according to the third embodiment of the present invention.

FIG. 5 is a schematic diagram showing the structure of the EUV light source device according to the third embodiment of the present invention. The present embodiment shows another concrete example in which a piezoelectric element is used as the droplet blocking unit 107 shown in FIG. 1. Other structure is the same as that of the EUV light source device shown in FIG. 1.

The EUV light source device shown in FIG. 5 includes a piezoelectric element 140 of an actuator type provided with a blocking part 141 and a piezoelectric driver 142 for generating a drive signal to be supplied to the piezoelectric element 140. The blocking part 141 includes a blocking bar 141*a* the lengthwise side of which is in the direction of the column of droplets. The blocking bar 141*a* collides with a plurality of droplets 108*a* when the piezoelectric element 141 expands and contracts once to break the droplets 108*a* or change the orbit thereof. In this manner, by breaking the plurality of droplets 108*a* at a time, the drive frequency of the piezoelectric element can be reduced, and therefore, it is possible to lengthen the life of the piezoelectric element.

In the present embodiment, it may also be possible to provide a blocking plate having a wide area in opposition to the column of droplets instead of the blocking bar 141*a*. Also in the present embodiment, similar to that shown in FIG. 3, it may be possible to form an inclination at the tip of the blocking bar 141*a* or to provide a heater. Further, similar to that shown in FIG. 4, it may also be possible to provide a plurality of piezoelectric elements provided with the blocking part 141 including the blocking bar 141*a*, respectively, and drive them simultaneously or alternately.

Figure 6:
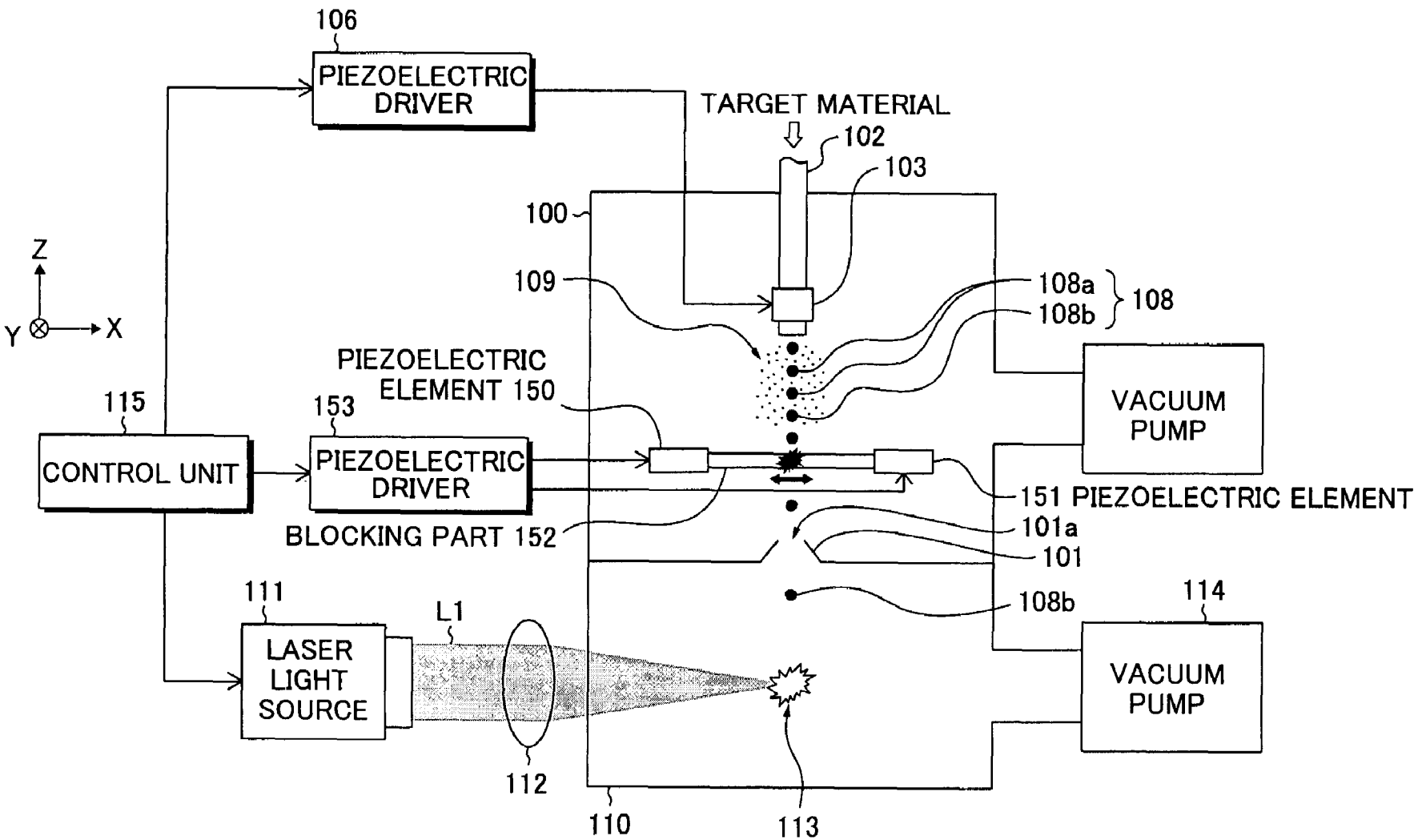
FIG. 6 is a schematic diagram showing a structure of the EUV light source device according to the fourth embodiment of the present invention.

FIG. 6 is a schematic diagram showing the structure of the EUV light source device according to the fourth embodiment of the present invention. The present embodiment shows another concrete example in which a piezoelectric element is used as the droplet blocking unit 107 shown in FIG. 1. Other structure is the same as that of the EUV light source device shown in FIG. 1.

As shown in FIG. 6, the EUV light source device includes two piezoelectric elements 150 and 151 of an actuator type, a blocking part 152 provided between the two piezoelectric elements 150 and 151, and a piezoelectric driver 153 for generating drive signals to be supplied to the two piezoelectric elements 150 and 151.

Figure 7:
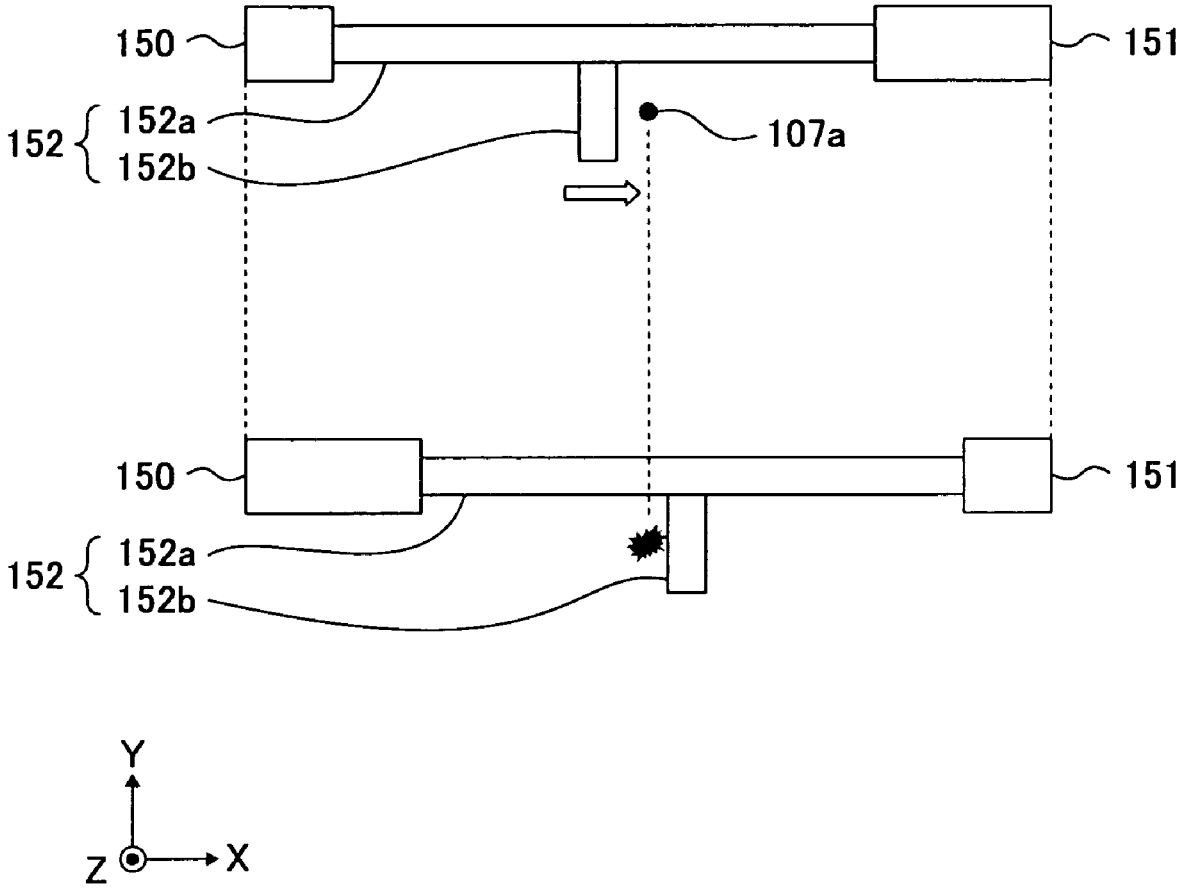
FIG. 7 is a schematic diagram showing operation of a piezoelectric element and a blocking unit.

FIG. 7 shows the operation of the piezoelectric elements 150 and 151 and the blocking part 152 shown in FIG. 6 when viewed from the nozzle 102 side (in the z-axis direction). The blocking part 152 includes a positioning part 152*a* connected to the piezoelectric elements 150 and 151 and a protrusion part 152*b* provided on the positioning part 152*a*. The piezoelectric driver 153 generates a drive signal for causing one of the piezoelectric elements 150 and 151 to expand and a drive signal for causing the other to contract when the droplets 108*a* not to be irradiated with a laser beam are about to pass through under the control of the control unit 115. Thereby, accompanying the expansion and contraction of the piezoelectric elements 150 and 151, the positioning part 152*a* moves, and at that time, the protrusion part 152*b* collides with the droplets 108*a*.

The reason why the blocking part 152 is moved by using the two piezoelectric elements in the present embodiment is as follows. In general, the piezoelectric element of an actuator type has a large mechanical strength against the compression stress at the time of expansion, however, has a small mechanical strength against the tensile stress at the time of contraction. Because of this, it will be a large burden on the piezoelectric element to perform both the "pressing" action and "pulling" action on the blocking part. Accordingly, it is intended that the stress burden when one of the elements contracts is covered by the expansion of the other element by driving the two piezoelectric elements 150 and 151 in synchronization. Due to this, it is possible to reduce the mechanical burden on each of the piezoelectric elements 150 and 151 in order to lengthen the life thereof.

Incidentally, in order to expand one of the piezoelectric elements 150 and 151 and contract the other, it is one way to dispose the piezoelectric elements 150 and 151 such that the directions of the polarization of the piezoelectric materials are opposite to each other and to supply drive signals in the same phase to the piezoelectric elements 150 and 151, respectively. Alternatively, it is another way to dispose the piezoelectric elements 150 and 151 such that the directions of the polarization of the piezoelectric materials are the same and to supply drive signals in phases opposite to each other to the piezoelectric elements 150 and 151.

Also in the present embodiment, similar to that shown in FIG. 3, it may be possible to form an inclination at one end of the protrusion part 152*b* or provide a heater. Alternatively, similar to that shown in FIG. 5, it may also be possible to form the shape of the protrusion part 152*b* into a planar shape having its length in the direction of the column of droplets so as to break the plurality of droplets 108*a* at a time. Further, similar to that shown in FIG. 4, it may also be possible to provide the plurality of droplet blocking units including the blocking part and the two piezoelectric elements provided to both the ends thereof and drive them alternately.

Figure 8:
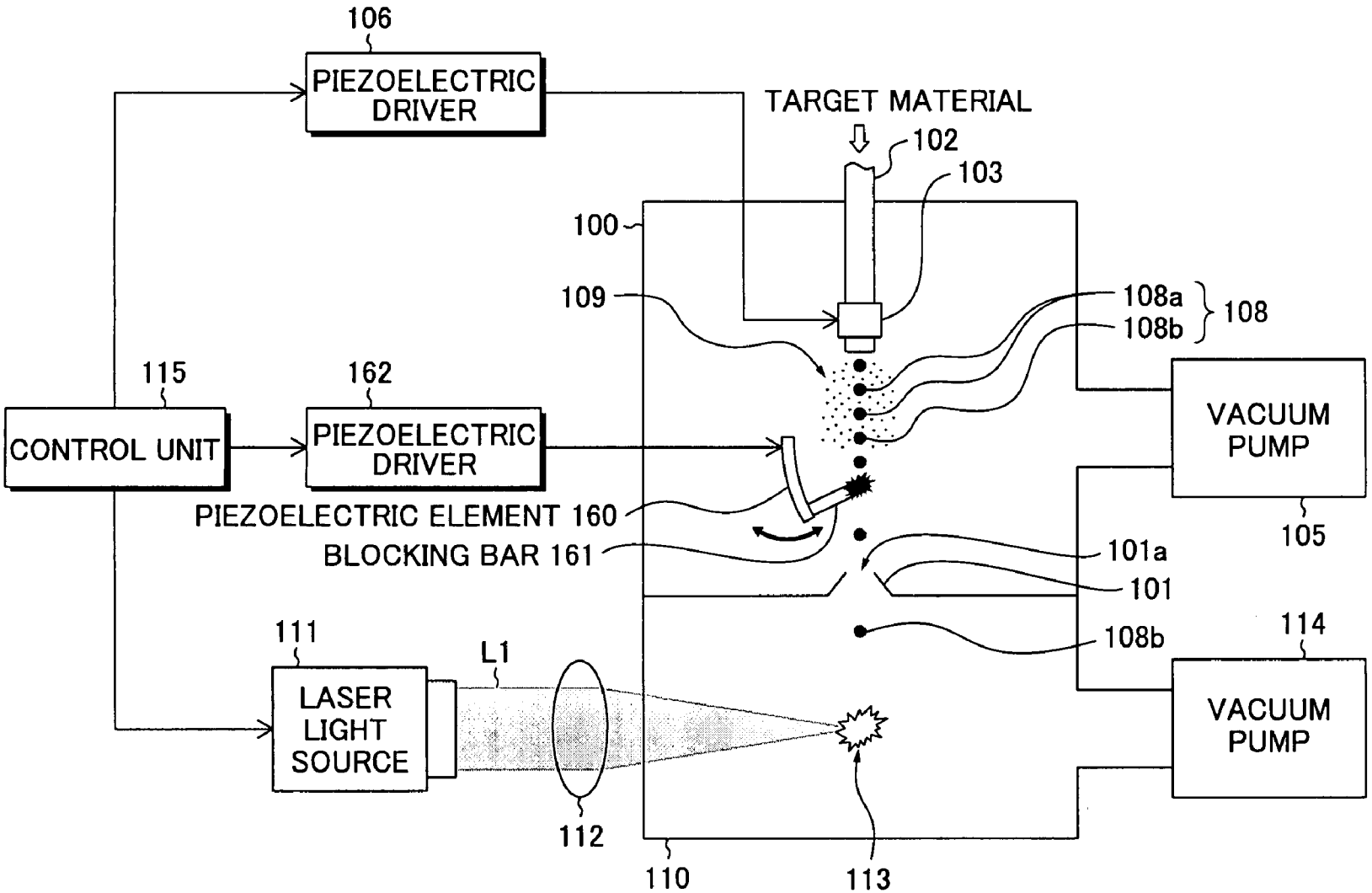
FIG. 8 is a schematic diagram showing a structure of the EUV light source device according to the fifth embodiment of the present invention.

FIG. 8 is a schematic diagram showing the structure of the EUV light source device according to a fifth embodiment of the present invention. The present embodiment shows another concrete example in which a piezoelectric element is used as the droplet blocking unit 107 shown in FIG. 1. Other structure is the same as that of the EUV light source device shown in FIG. 1.

As shown in FIG. 8, the EUV light source device includes a piezoelectric element 160 provided with a blocking bar 161 and a piezoelectric driver 162 for generating a drive signal to be supplied to the piezoelectric element. In the present embodiment, as the piezoelectric element 160, a bending type (bending displacement type) including a bimorph type and a multimorph type is used.

Figure 9A:
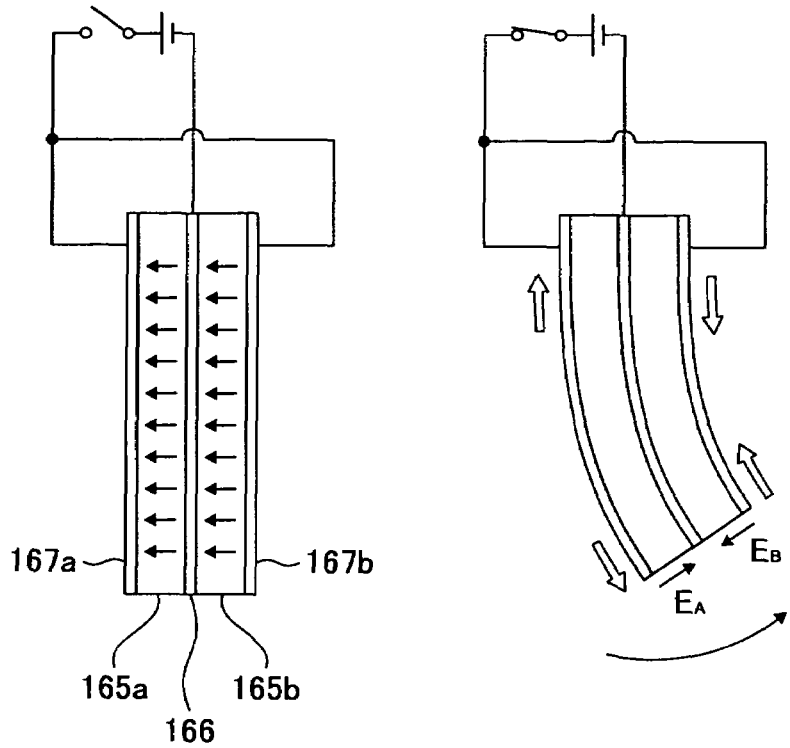
FIGS. 9A and 9B are schematic diagrams showing a structure of a bymorph type piezoelectric element.
Figure 9B:
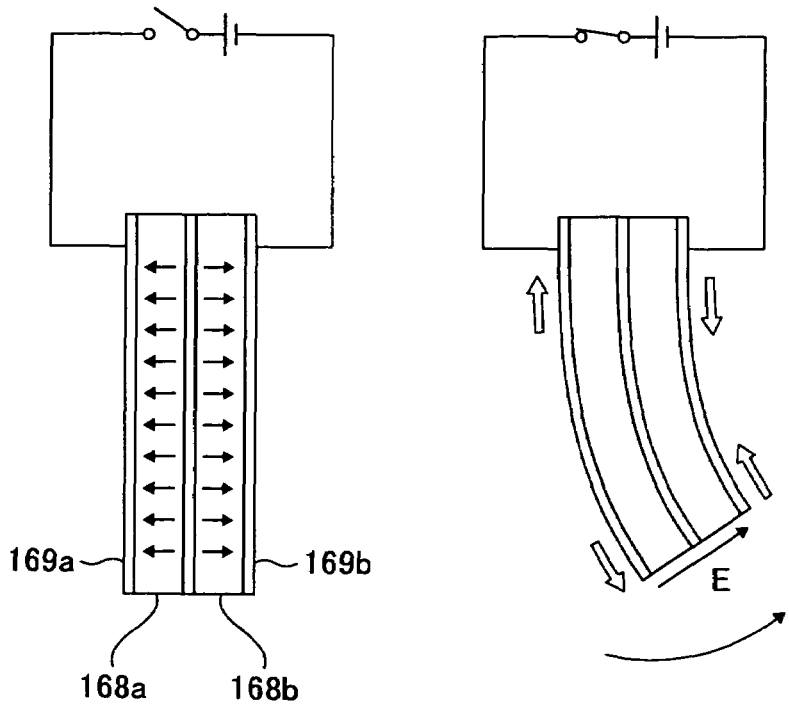

FIGS. 9A and 9B are schematic diagrams showing the structure of a piezoelectric element of the bimorph type. In FIGS. 9A and 9B, the arrows shown in piezoelectric materials 165*a* and 165*b*, and 168*a* and 168*b* indicate the direction of polarization. The piezoelectric element shown in FIG. 9A is called a parallel type and is fabricated by bonding the two piezoelectric materials 165*a* and 165*b* to each other via an electrode 166 such that the direction of polarization is the same and forming electrodes 167*a* and 167*b* respectively in the piezoelectric materials 165*a* and 165*b*. In such a piezoelectric element, an electric field EA is applied to the piezoelectric material 165*a* via the electrodes 167*a* and 166 and an electric field $E_B$ in the opposite direction to the electric field EA is applied to the piezoelectric material 165*b* via the electrodes 167*b* and 166. Thereby, the piezoelectric material 165*a* on one hand expands and the other piezoelectric material 165*b* contracts, and as a result, the piezoelectric element bends in the direction of the arrow (in the rightward direction in the figure). On the other hand, the piezoelectric element shown in FIG. 9B is called a series type. In the piezoelectric element of a series type, the two piezoelectric materials 168*a* and 168*b* are bonded to each other such that the directions of polarization are opposite to each other. By applying an electric field E in the same direction to these piezoelectric materials via the electrodes 169*a* and 169*b*, the piezoelectric material on one hand expands and the other piezoelectric material contracts, and as a result, the piezoelectric element bends. In addition, in the piezoelectric element of the multimorph type, a plurality of piezoelectric materials is further laminated.

Referring to FIG. 8 again, when the piezoelectric driver 162 generates a drive signal for driving the piezoelectric element 160 under the control of the control unit 115, the piezoelectric element 160 bends. As a result, the blocking bar 161 provided to the piezoelectric element 160 collides with the droplets 108*a* and breaks the droplets 108*a* or changes the orbit thereof.

In general, in the piezoelectric element of the bending type, compared to the piezoelectric element of the actuator type, an amount of displacement at the front end to which the blocking bar is provided. Because of this, it is made possible to block the droplets 108 more securely. Also in the present embodiment, similar to that shown in FIG. 3, it may be possible to form an inclination at the tip of the blocking bar 161 or provide a heater. Further, similar to that shown in FIG. 5, it may also be possible to break the plurality of droplets 108*a* at a time by providing a blocking member (blocking bar or blocking plate) having its length in the direction of the column of droplets. Alternatively, as shown in FIG. 4, it may also be possible to dispose a plurality of units.

Figure 10:
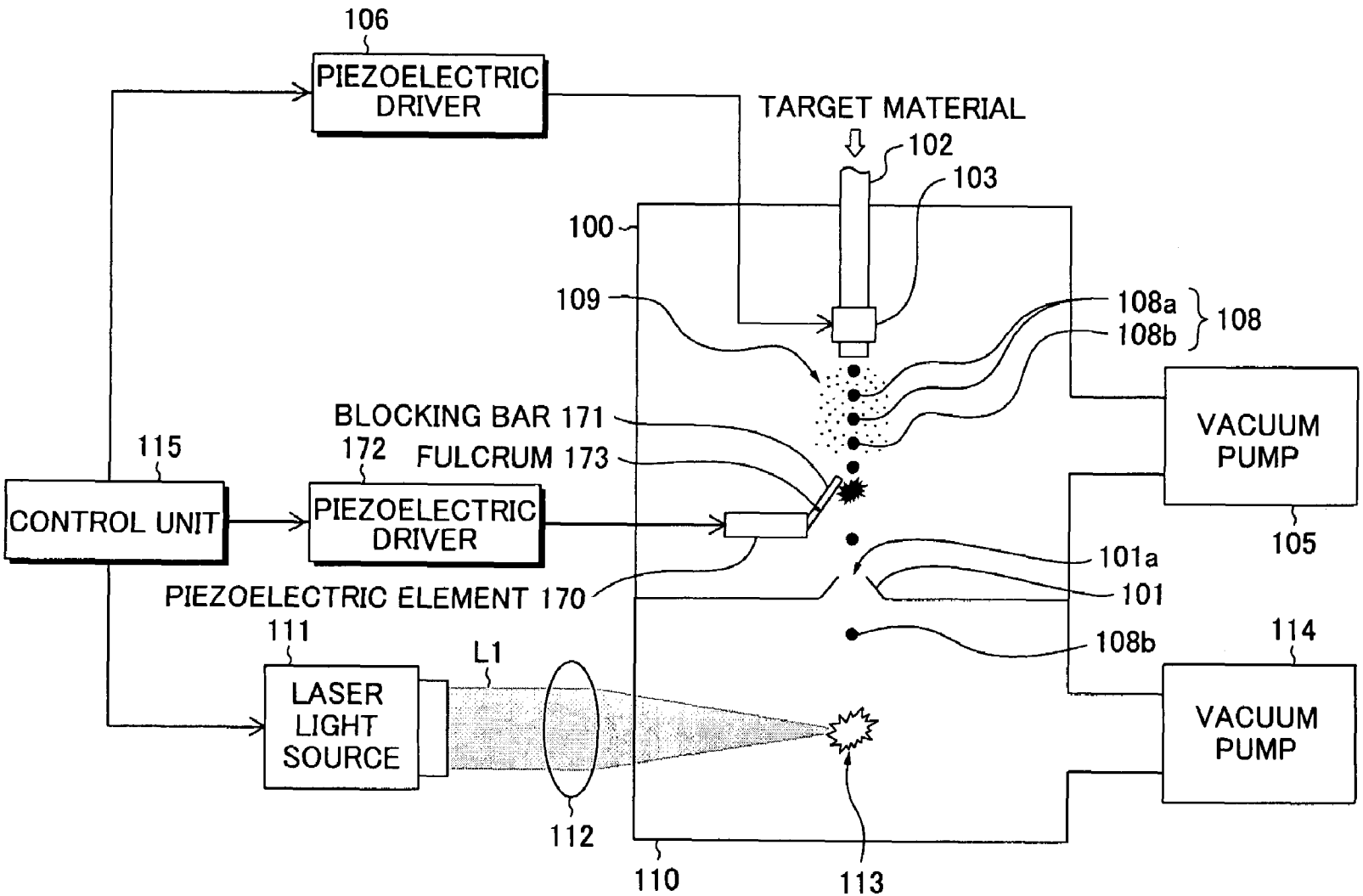
FIG. 10 is a schematic diagram showing a structure of the EUV light source device according to the sixth embodiment of the present invention.

FIG. 10 is a schematic diagram showing the structure of an EUV light source device according to a sixth embodiment of the present invention. The present embodiment shows another concrete example in which a piezoelectric element is used as the droplet blocking unit 107 shown in FIG. 1. Other structure is the same as that of the EUV light source device shown in FIG. 1. As shown in FIG. 10, the EUV light source device includes a piezoelectric element 170 of the actuator type provided with a blocking bar 171 and a piezoelectric driver 172.

Figure 11:
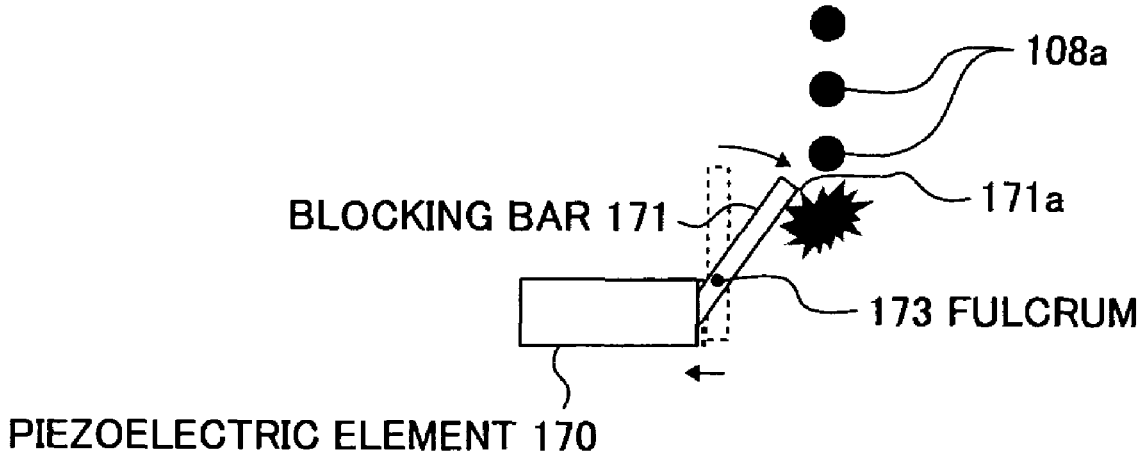
FIG. 11 is a schematic diagram for explaining operation of the piezoelectric element and blocking bar as shown in FIG. 10.

FIG. 11 shows the piezoelectric element 170 and the blocking bar 171 both being enlarged. The blocking bar 171 is rotatably supported at a fulcrum 173 and engaged with the piezoelectric element 170 at one end. The piezoelectric element 170 is caused to contract by the drive signal supplied from the piezoelectric driver 172. As a result, as shown in FIG. 11, the other end (collision point 171*a*) of the blocking bar 171 rotates around the fulcrum 173 as its rotation axis and collides with the droplets 108*a*.

As described above, in the present embodiment, by utilizing the principle of the lever, the collision point 171*a* of the blocking bar 171 with the droplets is moved.

Thereby, even in the case where the amount of displacement of the piezoelectric element 170 is small, it is possible to make large the amount of displacement of the collision point 171*a* by adjusting the position of the fulcrum. Consequently, it is made possible to break or so the droplets 108*a* more securely. Also in the present embodiment, similar to that shown in FIG. 3, it may also be possible to form an inclination at the collision point 171*a* of the blocking bar 171 or provide a heater. Alternatively, it may also be possible to break or so the plurality of the droplets 108*a* at a time, similar to that shown in FIG. 5, by providing a blocking part having its length in the direction of the column of droplets. Further, similar to that shown in FIG. 4, it may also be possible to provide a plurality of blocking units including a piezoelectric element and a blocking bar having a fixed fulcrum and drive them alternately.

Figure 12:
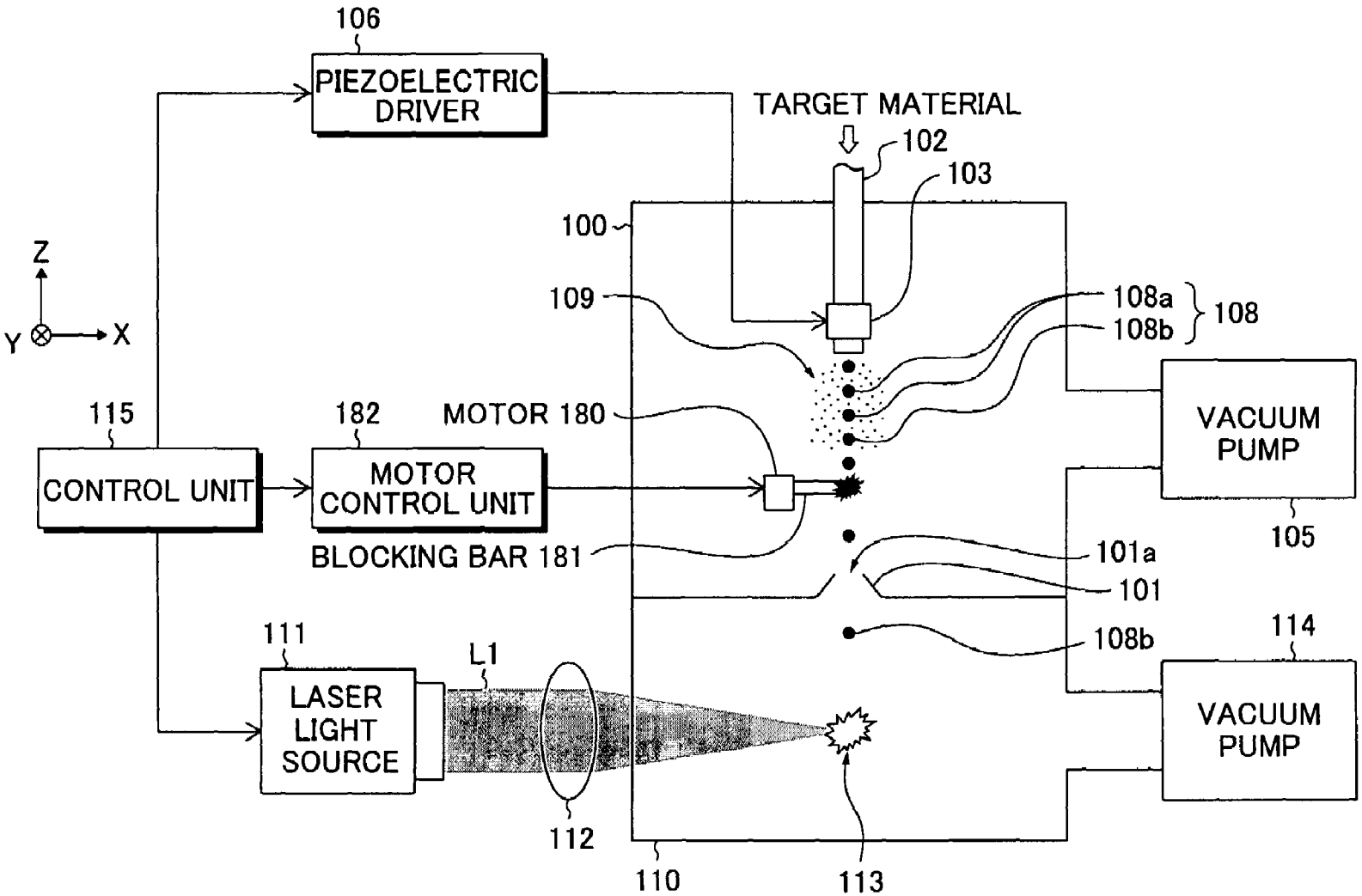
FIG. 12 is a schematic diagram showing a structure of the EUV light source device according to the seventh embodiment of the present invention.

FIG. 12 is a schematic diagram showing the structure of the EUV light source device according to a seventh embodiment of the present invention. In the EUV light source device, the droplet blocking unit 107 shown in FIG. 1 employs a structure in which a motor is used. Other structure is the same as that of the EUV light source device shown in FIG. 1.

Figure 13:
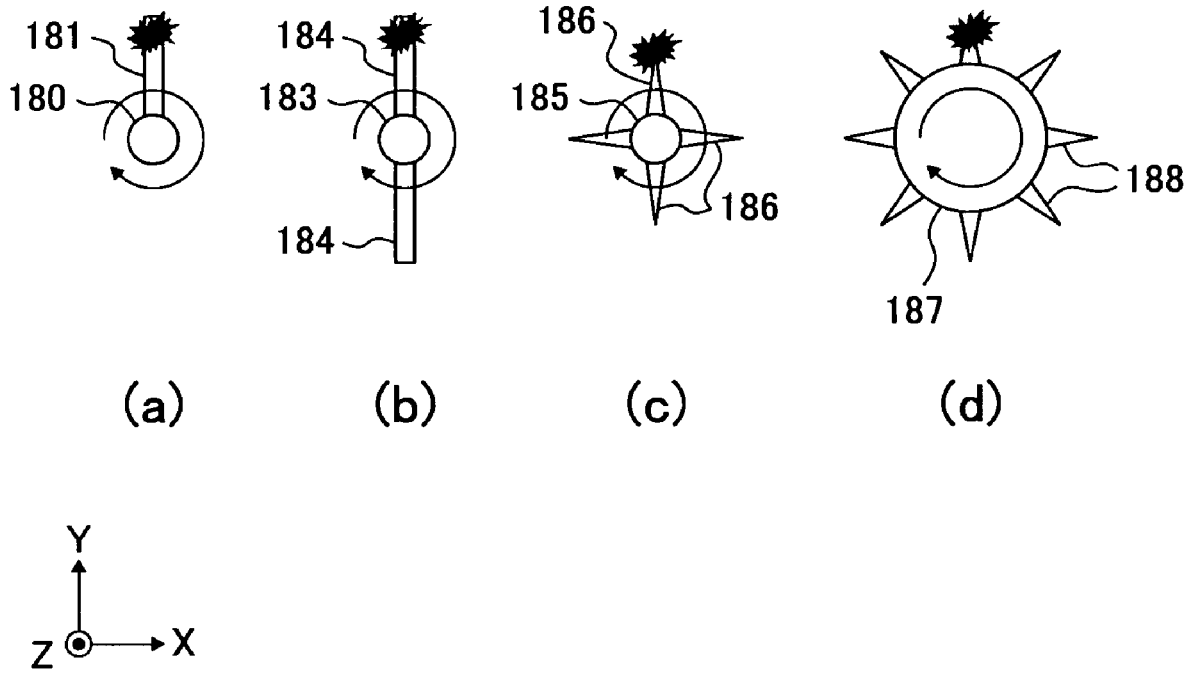
FIG. 13 is a plan view showing a motor and a blocking bar as shown in FIG. 12 and a variation of the blocking bar.

As shown in FIG. 12, the EUV light source device includes a motor 180 provided with a blocking bar 181 and a motor control unit 182 for controlling the operation of the motor 180. In addition, FIG. 13 (*a*) shows a diagram when the motor 180 and the blocking bar 181 are viewed in the Z-axis direction. As shown in FIG. 13 (*a*), the motor 180 rotates about the Z-axis as its rotation axis, and accompanying this, the blocking bar 181 rotates in the XY plane. The length of the blocking bar 181 is adjusted such that the blocking bar 181 crosses the orbit of the droplets 108.

The motor control unit 182 rotates the motor 180 at predetermined speed and timing under the control of the control unit 115. For example, the motor control unit 182 rotates the motor 180 at a frequency substantially equivalent to the generation frequency of the droplets at the timing of collision of the blocking bar 181 with the droplets 108*a*. Thereby, the droplets 108*a* are broken one at a time by the rotating blocking bar 181. On the contrary, the motor control unit 182 stops the rotation or changes the rotation speed of the motor 180 when the droplet 108*b* is about to pass through. Thereby, the droplets 108*b* pass through the opening portion 101*a* without colliding with the blocking bar 181.

FIG. 13 (*a*) to (*d*) show variations of the blocking bar provided to the motor. For example, as shown in FIG. 13 (*b*), it may also be possible to provide two blocking bars 184 at positions in opposition to each other of the motor 183. In this case, compared to that shown in FIG. 13 (*a*), the rotation speed (rotation frequency) of the motor can be approximately halved and the burden on the motor can be reduced. In addition, as shown in FIG. 13 (*c*), it may also be possible to provide a plurality of blocking blades 186 around a motor 185. Further, as shown in FIG. 13 (*d*), it may also be possible to provide a gear-like blocking part 188 around a motor 187.

Also in the present embodiment, similar to that shown in FIG. 3, it may be possible to form an inclination at the tip of the blocking bar etc. or provide a heater. Alternatively, it may also be possible to break or so the plurality of the droplets 108*a* at a time, similar to that shown in FIG. 5, by providing a member (blocking bar of blocking plate) having its length in the direction of the column of droplets at the tip of the blocking bar. Further, similar to that shown in FIG. 4, it may also be possible to provide a plurality of blocking units including a motor and a blocking bar or the like and drive them simultaneously or alternately.

Figure 14:
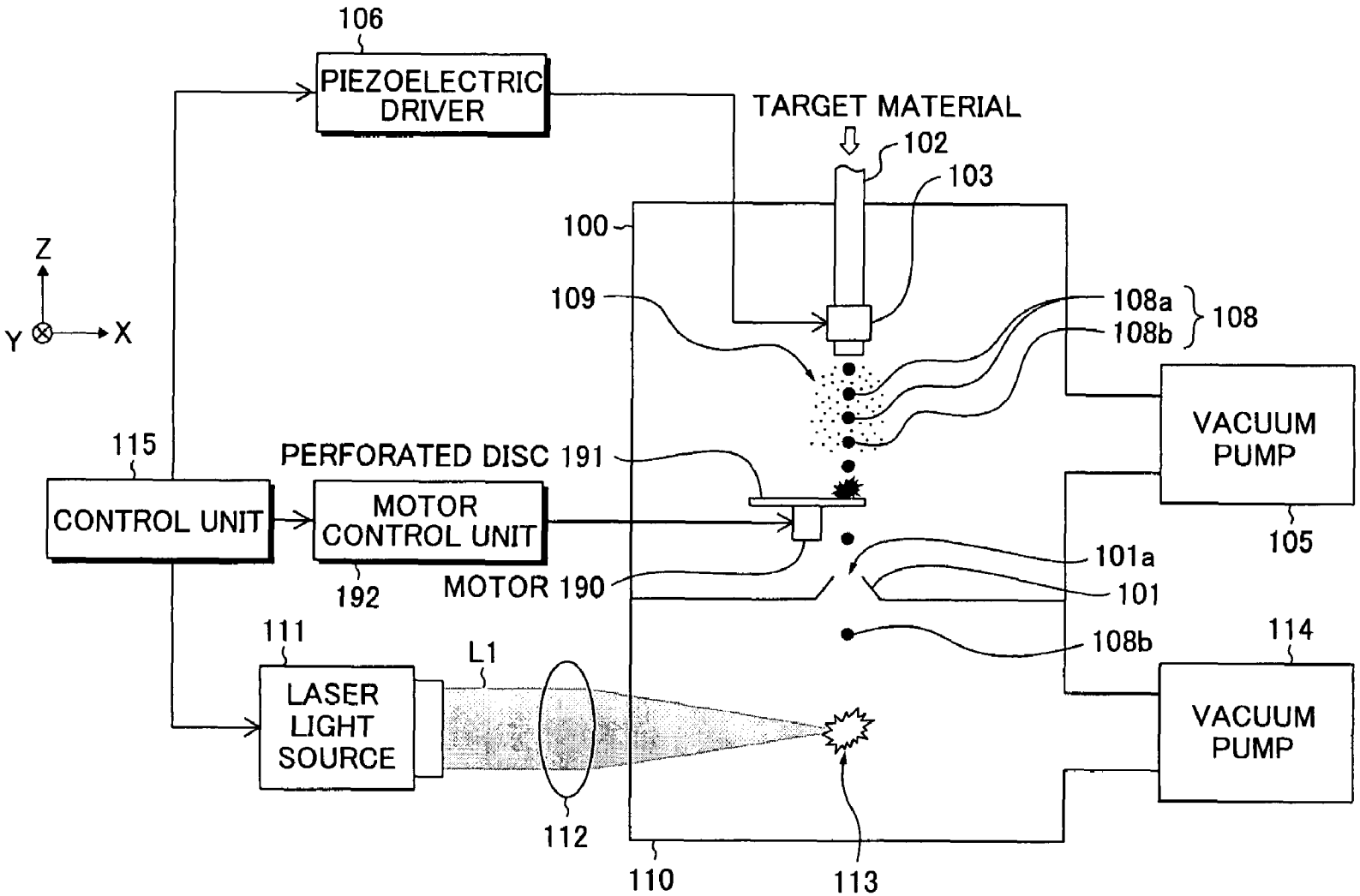
FIG. 14 is a schematic diagram showing a structure of the EUV light source device according to the eighth embodiment of the present invention.

FIG. 14 is a schematic diagram showing the structure of the EUV light source device according to an eighth embodiment of the present invention. The present embodiment shows another concrete example in which a motor is used as the droplet blocking unit 107 shown in FIG. 1. Other structure is the same as that of the EUV light source device shown in FIG. 1.

Figure 15A:
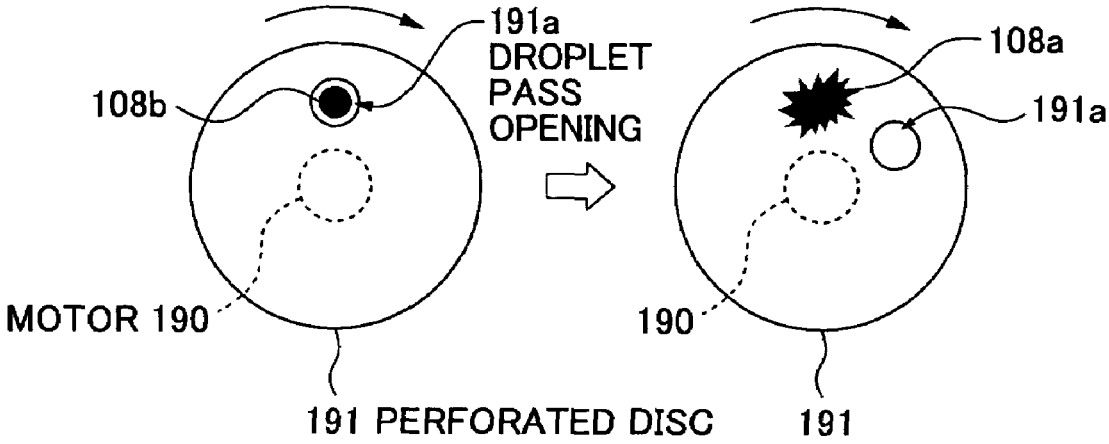
FIGS. 15A and 15B are plan views for explaining operation of a motor and a disc formed with a hole as shown in FIG. 14.

As shown in FIG. 14, the EUV light source device includes a motor 190 provided with a perforated disc 191 and a motor control unit 192 for controlling the operation of the motor 190. In addition, FIG. 15A shows a diagram when the motor 190 and the perforated disc 191 are viewed in the Z-axis direction. As shown in FIG. 15A, the motor 190 rotates about the Z-axis as its rotation axis and accompanying this, the perforated disc 191 rotates in the XY plane. In the perforated disc 191, a droplet pass opening portion 191*a* the position of which is adjusted so as to pass through the orbit of the droplets 108 is formed.

The motor control unit 192 rotates the motor 190 at predetermined speed and timing under the control of the control unit 115. For example, the motor control unit 192 rotates the motor 190 at speed substantially equivalent to the generation frequency of the droplets in synchronization with the timing such that the droplet pass opening portion 191*a* passes through the orbit of the droplets 108 when the droplet 108*b* is about to pass through at the height of the perforated disc 191.

Thereby, the droplets 108*b* pass through the droplet pass opening portion 191*a* and are led to the opening portion 101*a*, and on the other hand, the droplets 108*a* collide with the perforated disc 191 to be broken or so.

Figure 15B:
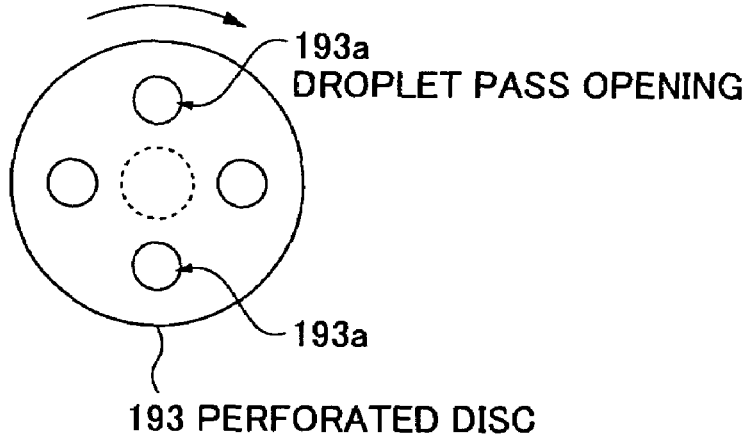
Figure 15B:
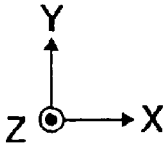

In the present embodiment, two or more droplet pass opening portions may be formed in the perforated disc. For example, as shown in FIG. 15B, by forming four droplet pass opening portions 193*a* in a perforated disc 193, it is possible to reduce the rotation speed of the motor to ¼ compared to the case shown in FIG. 15A, resulting in a reduction in the burden on the motor.

Figure 16:
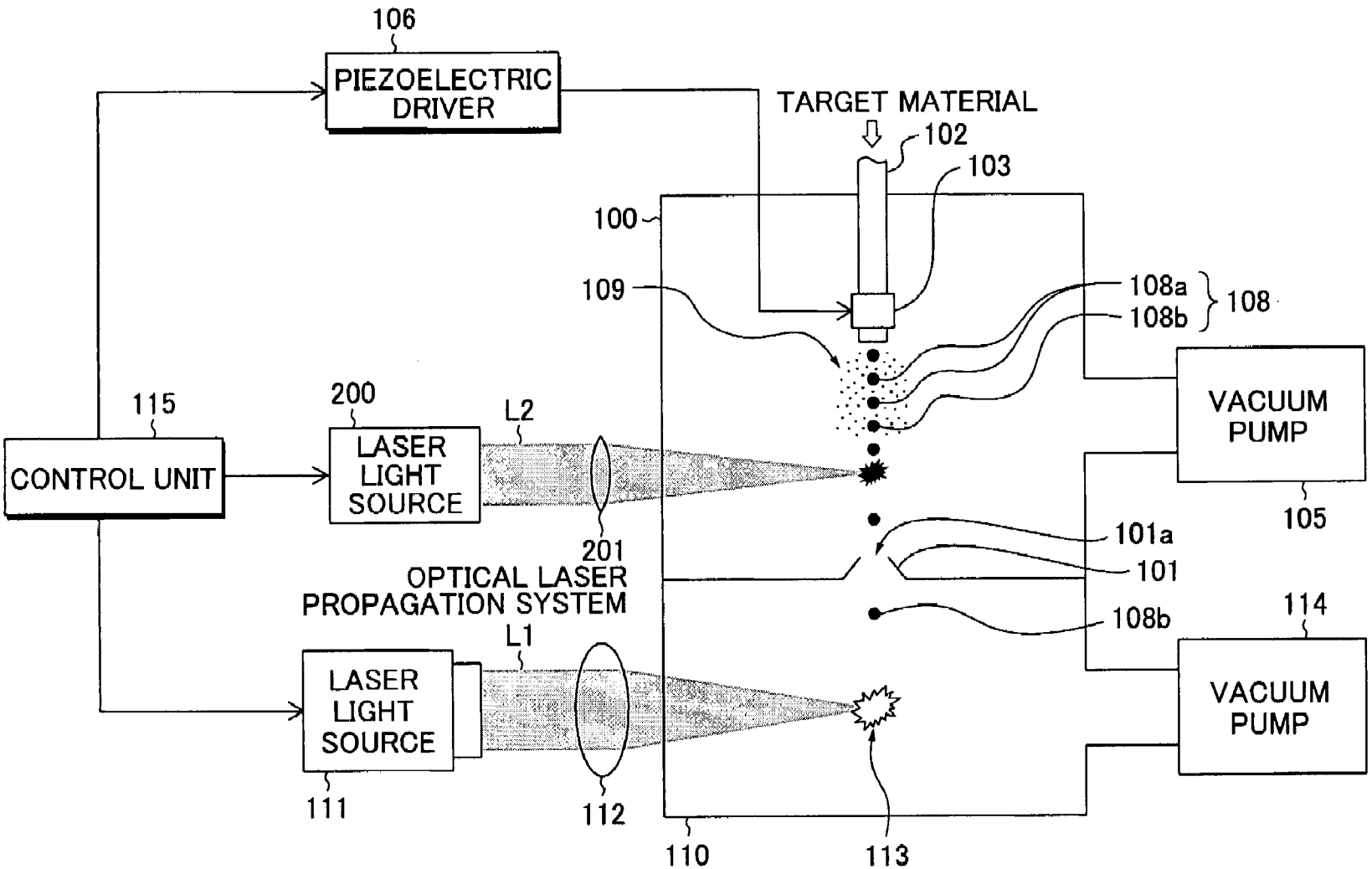
FIG. 16 is a schematic diagram showing a structure of the EUV light source device according to the ninth embodiment of the present invention.

FIG. 16 is a schematic diagram showing the structure of the EUV light source device according to a ninth embodiment of the present invention. In the EUV light source device, the droplet blocking unit 107 shown in FIG. 1 employs a structure in which a laser light source is used. Other structure is the same as that of the EUV light source device shown in FIG. 1.

As shown in FIG. 16, the EUV light source device includes a laser light source 200 to be used to break droplets and an optical laser propagation system 201 for guiding a laser beam L2 emitted from the laser light source 200 onto the orbit of the droplets 108. The laser light source 200 emits the laser beam L2 at a predetermined repetitive operation frequency and timing under the control of the control unit 115. For example, the laser light source 200 emits the laser beam L2 in accordance with the generation frequency of the droplets and stops the emission of the laser beam L2 in accordance with the repetitive operation frequency of the laser light source 111 for generating plasma. In addition, the optical laser propagation system 201 collects the laser beam L2 such that it has a predetermined spot radius on the orbit of the droplets 108. Thereby, the droplets 108*a* are irradiated with the laser beam and broken or changed in the orbit thereof. On the other hand, the droplets 108*b* pass through the opening portion 101*a* without being irradiated with the laser beam and are guided into the plasma generation chamber 110.

The energy of the laser beam L2 for breaking the droplets is sufficient if it can at least break or evaporate the droplets 108*a* and it is desirable to be capable of changing the orbit of the remains such that majority of the remains of the droplets broken thereby do not pass through the opening portion 101*a*. In addition, it is desirable for the energy of the laser beam L2 to be within a range that does not affect the surrounding droplets or damage the surrounding components by the thermal impact generated when the droplets 108*a* are broken. In particular, it should be noted that the speed or the orbit of the droplets 108*b* guided into the plasma generation chamber 110 be not changed.

As the laser light source 200, any kind of laser can be used, such as the YAG laser, excimer laser, carbon dioxide laser, semiconductor laser, etc., as long as it can output a degree of energy capable of breaking the droplets.

Further, it is sufficient for the spot radius of the laser beam L2 to have a size large enough to be capable of breaking one droplet. Incidentally, it may also be possible to provide the optical laser propagation system 201 outside the droplet generation chamber 100, as shown in FIG. 16, or provide a part or the whole thereof inside the droplet generation chamber 100.

Also in the present embodiment, similar to that shown in FIG. 4, it may be possible to provide a plurality of units including the laser light source for breaking droplets and the optical laser propagation system and drive them simultaneously or alternately. In such a case, since the drive frequency of each laser light source can be reduced, it is possible to lengthen the life of the laser light source. Further, a laser light source having a low pulse repetitive frequency can also be used.

Figure 17:
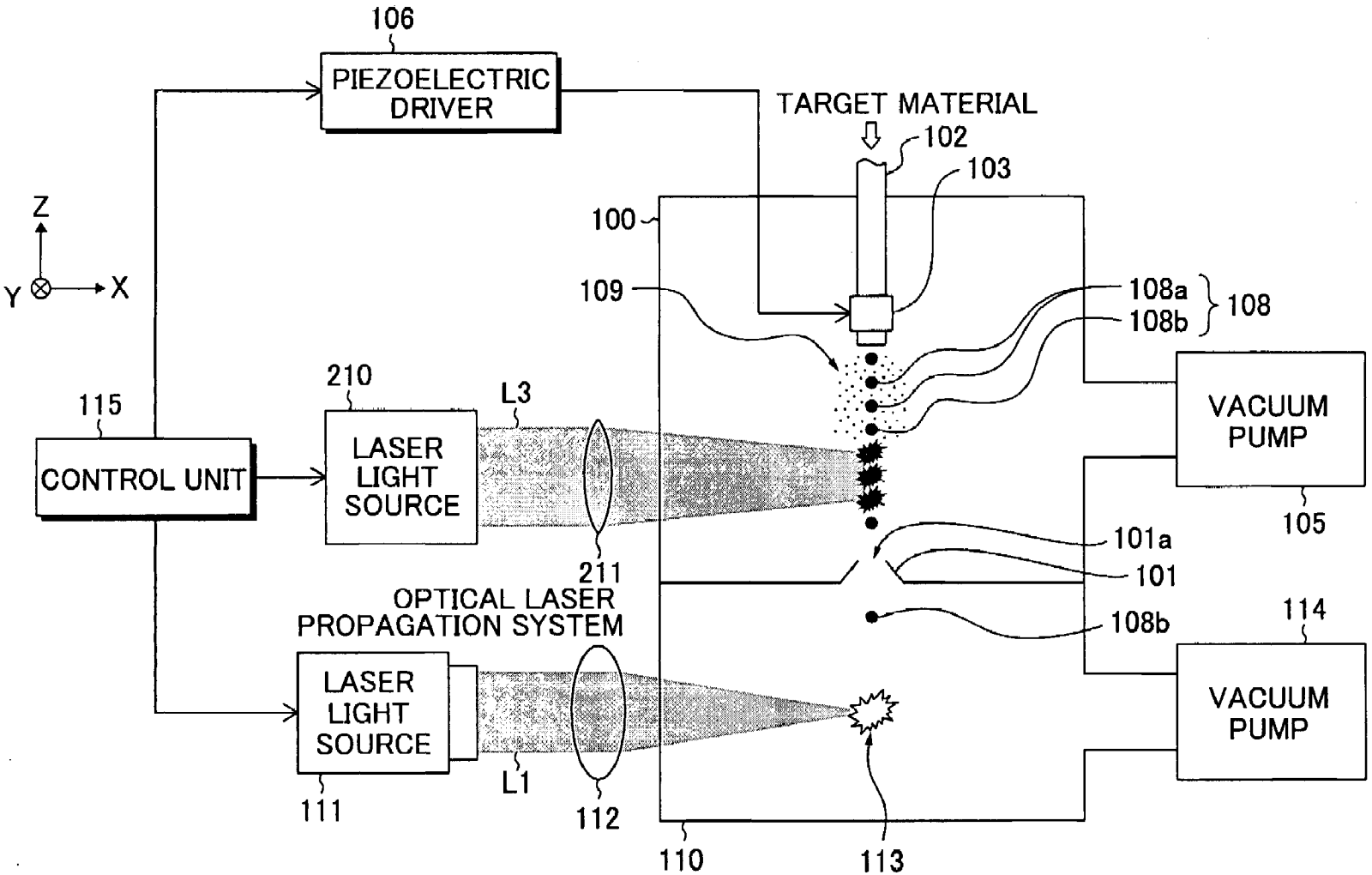
FIG. 17 is a schematic diagram showing a structure of the EUV light source device according to the tenth embodiment of the present invention.

FIG. 17 is a schematic diagram showing the structure of the EUV light source device according to a tenth embodiment of the present invention. The EUV light source device has a laser light source 210 and an optical laser propagation system 211 instead of the laser light source 200 and the optical laser propagation system 201 shown in FIG. 16. Other structure is the same as that of the EUV light source device shown in FIG. 16.

As shown in FIG. 17, the optical laser propagation system 211 collects a laser beam L3 emitted from the laser light source 210 such that a spot radius including a plurality of droplets is formed on the orbit of the droplets 108. Thereby, it is made possible to break the plurality of the droplets 108*a* by one-time laser emission, and therefore, it is made possible to lengthen the life of the laser light source 210 by reducing the drive frequency of the laser light source.

Figure 18:
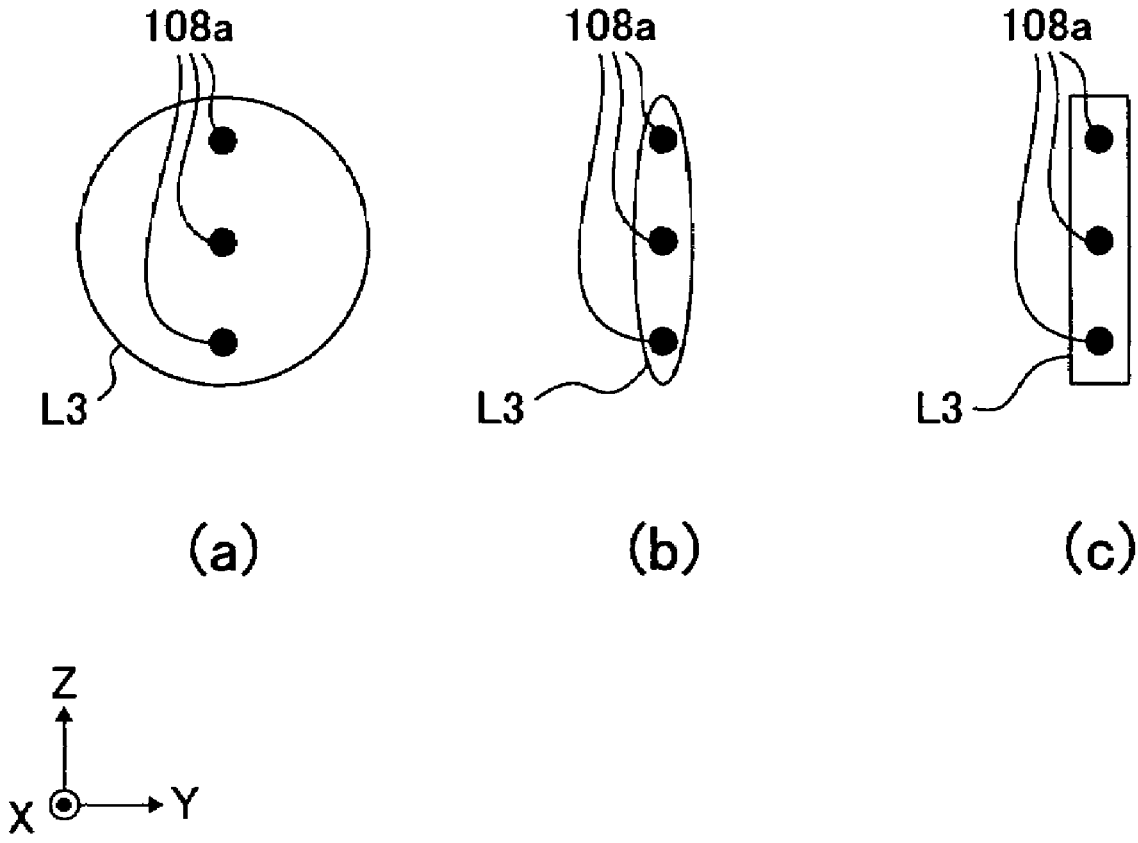
FIG. 18 is a cross section showing a laser beam collected by a laser light transmission optical system.

FIG. 18 (*a*) to (*c*) show cross sections (laser profiles) in the YZ plane of the laser beam L3 collected by the optical laser propagation system 211. In the present embodiment, as shown in FIG. 18 (*a*), a circular spot shape is used. However, an elliptic shape expanding in the direction of the column of droplets as shown in FIG. 18 (*b*) or a rectangle expanding in the direction of the column of droplets as shown in FIG. 18 (*c*) may be used. In these cases, the energy density can be increased by concentrating the laser beams into a narrow range, and therefore, it is made possible to surely and efficiently break the droplets.

Figure 19:
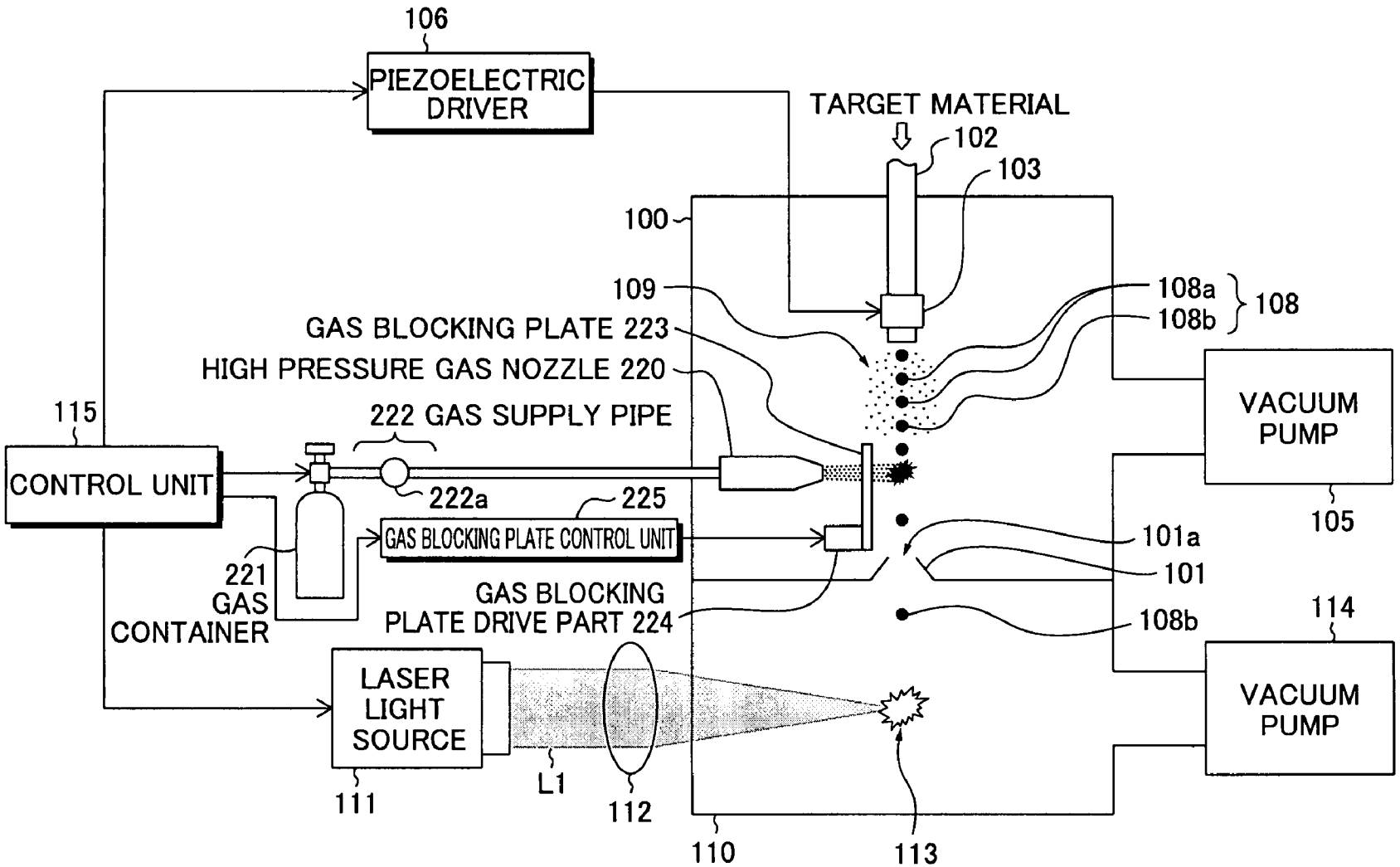
FIG. 19 is a schematic diagram showing a structure of the EUV light source device according to the eleventh embodiment of the present invention.

FIG. 19 is a schematic diagram showing the structure of the EUV light source device according to an eleventh embodiment of the present invention. In this EUV light source device, the droplet blocking unit 107 shown in FIG. 1 employs a structure in which a high pressure gas nozzle is used. Other structure is the same as that of the EUV light source device shown in FIG. 1.

As shown in FIG. 19, the EUV light source device includes a high pressure gas nozzle 220, a gas container 221, a gas supply pipe 222, a gas blocking plate 223, a gas blocking plate drive unit 224, and a gas blocking plate control unit 225.

The high pressure gas nozzle 220 injects a high pressure gas (hereinafter, referred to as "droplet break gas") to be used to break droplets. The injection power of the high pressure gas nozzle 220 may be sufficient if it can break the droplets or change the orbit of the droplets. However, it is undesirable to inject the gas excessively because it may be a factor to raise the pressure in the droplet generation chamber 100 and the plasma generation chamber 110.

The gas container 221 supplies a gas to the high pressure gas nozzle 220 via the gas supply pipe 222. It is desirable to use, as the kind of the droplet break gas, a gas that absorbs very little EUV light, such as a hydrogen gas ($H_2$), helium (He), Argon (Ar), etc. This is because there is the possibility that a part of the droplet break gas passes through the opening portion 101*a* and flows into the plasma generation chamber 110.

The gas supply pipe 222 is provided with a compressor 222*a*. The compressor 222*a* supplies a high pressure gas to the high pressure gas nozzle 220 by compressing the gas supplied from the gas container 221 when the residual quantity of gas in the gas container 221 lessens so that the supply pressure of the gas drops.

The gas blocking plate 223 is provided with a shutter to block the gas injected from the high pressure gas nozzle 220. This shutter is opened or closed by the gas blocking plate drive unit 224 that operates under the control of the gas blocking plate control unit 225. The gas blocking plate drive unit 224 keeps the shutter open when the droplets 108*a* are about to pass through in front of the shutter. Thereby, the droplets 108*a* are broken or their orbit is changed by being sprayed with the gas injected from the high pressure gas injection nozzle 220. On the other hand, the gas blocking plate drive unit 224 closes the shutter when the droplets 108*b* are about to pass through in front of the shutter. Thereby, the droplets 108*b* pass through the opening portion 101*a* and are guided to the plasma generation chamber 110 without being sprayed with the gas.

The spot radius of the droplet destroying gas on the orbit of the droplets 108 may be the size that can break one droplet 107*a* with one-time injection similar to that shown in FIG. 16, or may be the size that can break the plurality of the droplets 107*a* with one-time injection similar to that shown in FIG. 18 (*a*) to (*c*). It is possible to adjust such a spot radius by properly selecting the nozzle radius of the high pressure gas nozzle 220 and the injection speed of the gas.

Also in the present embodiment, similar to that shown in FIG. 4, it may be possible to provide a plurality of units including the high pressure gas nozzle and the gas container to inject the droplet break gas alternately from the plurality of high pressure gas nozzles. In such a case, since it is possible to stably inject the droplet break gas for a long time, the reliability of the operation of the EUV light source device can be improved.

Figure 20:
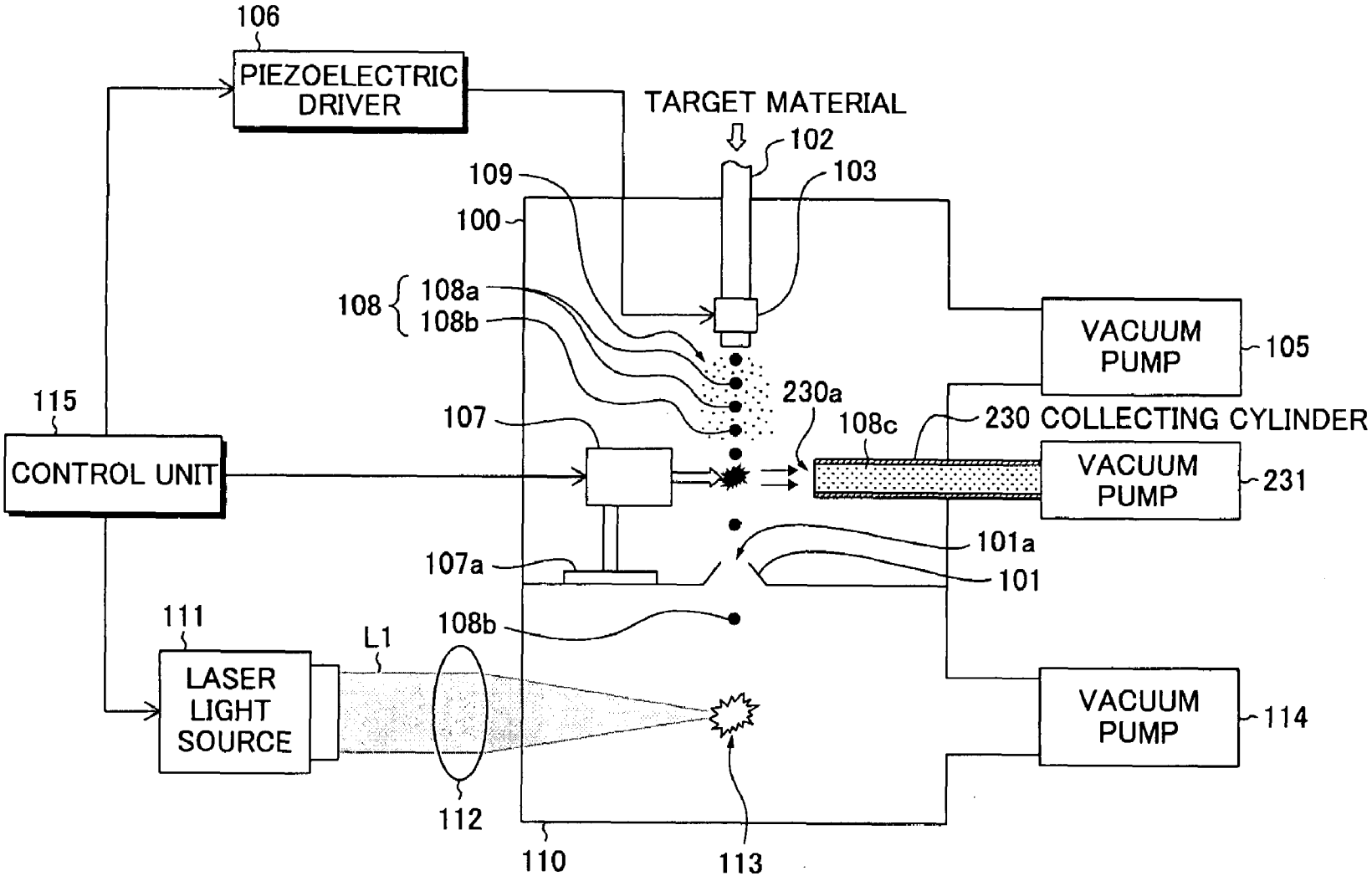
FIG. 20 is a schematic diagram showing a structure of the EUV light source device according to the twelfth embodiment of the present invention.

FIG. 20 is a schematic diagram showing the structure of the EUV light source device according to a twelfth embodiment of the present invention. The EUV light source device is further provided with a collecting cylinder for collecting broken droplets etc. in addition to the components of the EUV light source device shown in FIG. 1. Other structure is the same as that of the EUV light source device shown in FIG. 1.

As shown in FIG. 20, the EUV light source device includes a collecting cylinder 230 and a vacuum pump 231 connected to the collecting cylinder 230. The collecting cylinder 230 and the vacuum pump 231 intensively collect the remains of the droplets broken by the droplet blocking unit 107 and the droplets the orbit of which is changed. A collecting opening portion 230*a* of the collecting cylinder 230 is arranged in the vicinity of the droplet break point such that droplets and the like can be collected efficiently. Specifically, it is desirable to provide the collecting opening portion 230*a* at a position in opposition to the droplet blocking unit 107 with the column of droplets being sandwiched in between.

According to the present embodiment, before the remains 108*c* of the broken droplets and/or the droplets the orbit of which is changed diffuse into the droplet generation chamber 100, it is possible to collect them. Thereby, the remains 108*c* of the droplet and/or the evaporation gas can be suppressed from flowing into the plasma generation chamber 110, and therefore, it is made possible to maintain the inside of the plasma generation chamber 110 at a high vacuum state. As a result, it is made possible not only to improve the output efficiency of the EUV light but also to reduce in size the vacuum pump 114 etc. provided in the plasma generation chamber 110. Consequently, it is made possible to improve the performance and reliability of the EUV light source device.

In FIG. 20, the vacuum pumps 105 and 231 are provided in the droplet generation chamber 100, however, in the present embodiment, it is also possible to omit the vacuum pump 105. In other words, the vacuum pump 231 serves both to collect the remains 108*c* of droplets and to exhaust the inside of the droplet generation chamber 100. Thereby, it is made possible to reduce in size the whole of the EUV light source device.

Figure 21:
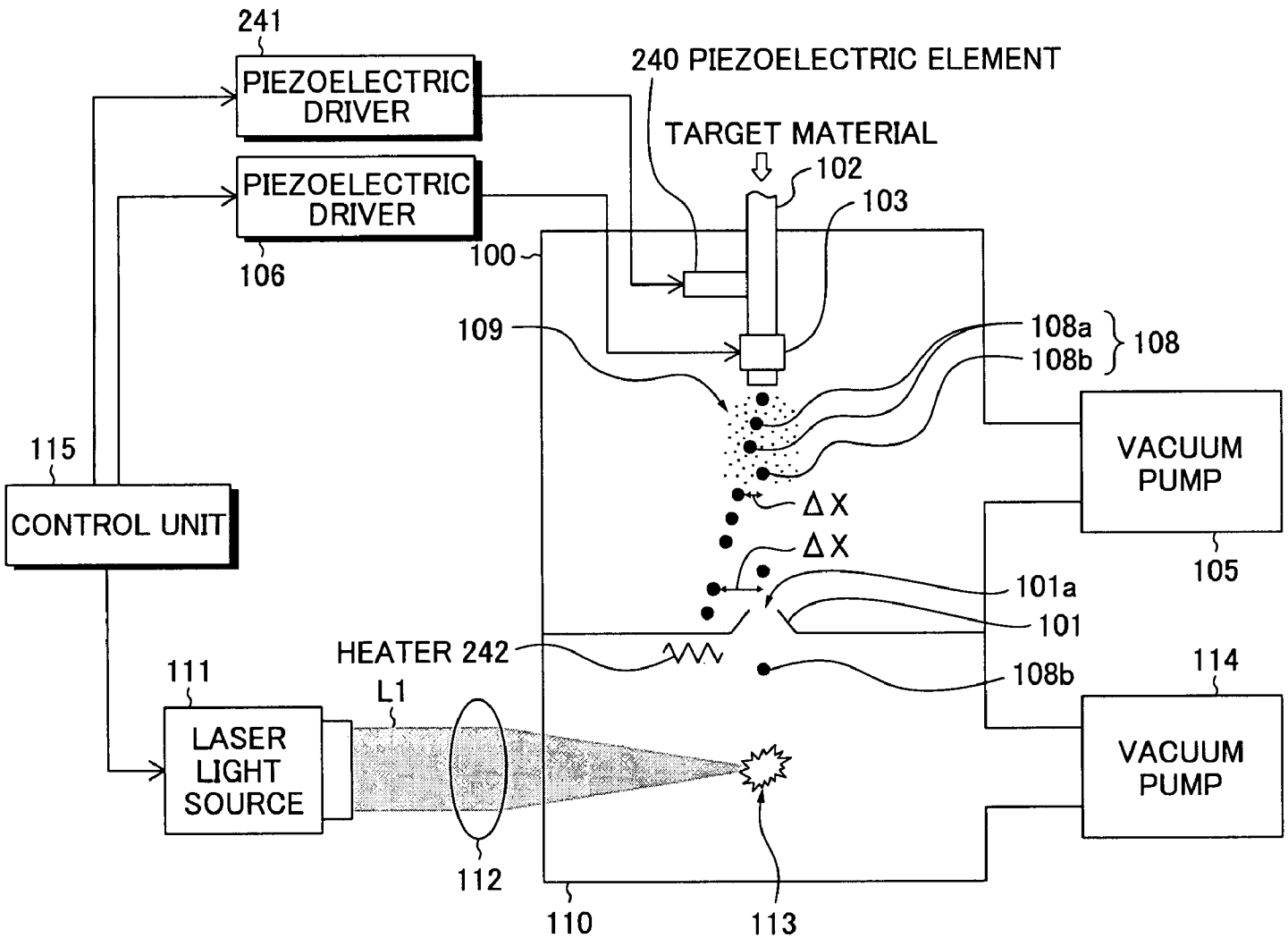
FIG. 21 is a schematic diagram showing a structure of the EUV light source device according to the thirteenth embodiment of the present invention.

FIG. 21 is a schematic diagram showing the structure of the EUV light source device according to a thirteenth embodiment of the present invention. The EUV light source device is provided with a mechanism for moving the nozzle 102 that injects the target material instead of the provision of the droplet blocking unit 107 in the EUV light source device shown in FIG. 1. Other structure is the same as that of the EUV light source device shown in FIG. 1.

As shown in FIG. 21, the EUV light source device includes a second piezoelectric element 240 provided to the nozzle 102, a piezoelectric driver 241 for generating a drive signal to be supplied to the piezoelectric element 240, and a heater 242 provided in the vicinity of the constriction part 101.

The piezoelectric driver 241 generates a drive signal to cause the piezoelectric element 240 to expand and contract at predetermined timing under the control of the control unit 115. The piezoelectric element 240 displaces the position of the nozzle 102 or inclines the direction of the nozzle 102 by expanding and contracting based on the supplied drive signal. As a result, it is possible to change the orbit of the droplets 108 dropping from the nozzle 102. The control unit 115 drives the piezoelectric element 240 such that the orbit of the droplets moves out of the direction of the opening portion 101*a* when the droplets 108*a* drop. Thereby, it is possible to prevent the droplets 108*a* from passing through the opening portion 101*a* to enter the plasma generation chamber 110 and guide only the droplets 108*b* into the plasma generation chamber 110.

Here, when the nozzle 102 is inclined, the orbit of the droplets 108*a* becomes nonparallel with respect to the original orbit not inclined. Because of this, the shift $\Delta X$ of the orbit of the droplets 108*a* from the original orbit becomes larger with time. Consequently, when the nozzle is inclined, the amplitude of the piezoelectric element 240 can be small compared to the case where the position of the nozzle is shifted, and therefore, it is possible to suppress the burden on the piezoelectric element.

By the way, there is the possibility that the droplets 108*a* that have been changed in their orbit and landed in the vicinity of the constriction part 101 may solidify immediately to block the opening portion 101*a*. Because of this, in the present embodiment, the heater 242 is provided in the vicinity of the constriction part 101 to prevent the droplets 108*a* from solidifying.

As the drive system of the piezoelectric element 240, a system may be used, in which the piezoelectric element is driven in synchronization with the generation frequency of the droplets such that the nozzle 102 is displaced or inclined each time the droplets 108*a* are generated. Alternatively, a system may be used, in which the piezoelectric element is driven in synchronization with the repetitive operation frequency of the laser light source 111 such that the nozzle is maintained in the state of being displaced or inclined while the droplets 108*a* are being generated and the nozzle 102 returns to its original position when the droplets 108*b* drop. In the case of the former system, it is necessary to reduce the drive frequency of the piezoelectric element 240 lower than the droplet generation frequency by the piezoelectric element 103 in order to generate uniform droplets. For example, it is desirable to set the drive frequency of the piezoelectric element 240 to ¼ or less of the droplet generation frequency.

Figure 22:
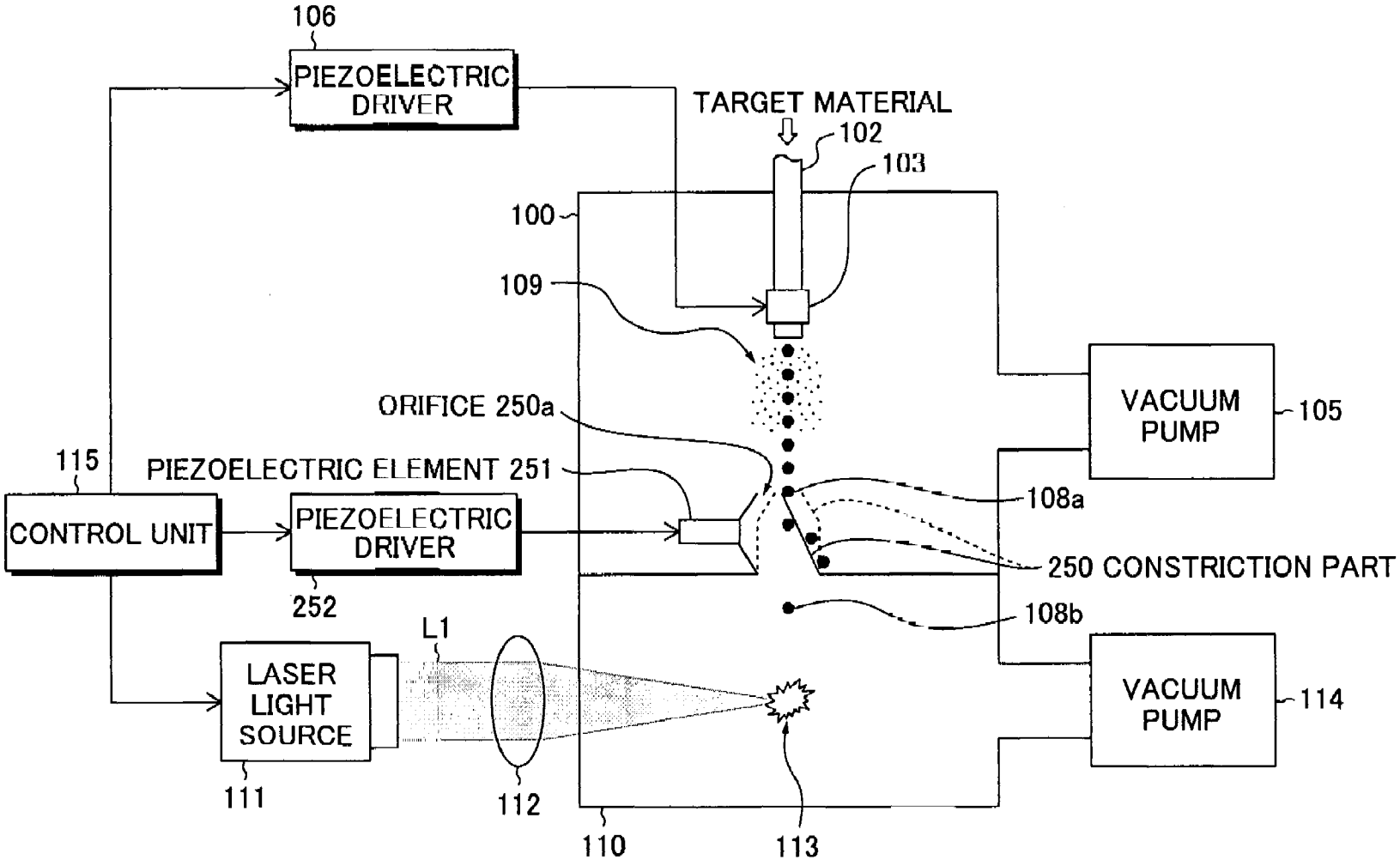
FIG. 22 is a schematic diagram showing a structure of the EUV light source device according to the fourteenth embodiment of the present invention.

FIG. 22 is a schematic diagram showing the structure of the EUV light source device according to a fourteenth embodiment of the present invention. The EUV light source device is provided with a mechanism for displacing the opening portion, that connects the droplet generation chamber 100 and the plasma generation chamber 110 to each other, instead of the provision of the droplet blocking unit 107 in the EUV light source device shown in FIG. 1. Other structure is the same as that of the EUV light source device shown in FIG. 1.

As shown in FIG. 22, the EUV light source device includes a constriction part 250 having an opening portion 250*a*, a piezoelectric element 251 provided to the constriction part 250, and a piezoelectric driver 252 for generating a drive signal to be supplied to the piezoelectric element 251.

In the present embodiment, the constriction part 250 is fabricated by a member that can be deformed when a proper external force is applied, for example, a flexible tube. Further, as a mechanism to apply an external force to the constriction part 250, the piezoelectric element 251 is used. The piezoelectric driver 252 generates a drive signal to expand or contract the piezoelectric element 251 under the control of the control unit 115 at predetermined timing. The piezoelectric element 251 causes the constriction part 250 to deform by expanding and contracting based on the supplied drive signal.

Thereby, it is made possible to displace the opening portion 250*a* formed at the constriction part 250. Consequently, it is made possible to prevent the droplets 108*a* from entering the plasma generation chamber 110 by driving the piezoelectric element 251 to shift the position of the opening portion 250*a* from the orbit of the droplets when the droplets 108*a* drop from the nozzle 102. On the other hand, when the droplets 108*b* drop, the droplets 108*b* are guided into the plasma generation chamber 110 without shifting the opening portion 250*a* from the orbit of the droplets.

Also in the present embodiment, similar to that shown in FIG. 21, a heater may be provided in the vicinity of the constriction part 250. Due to this, it is possible to prevent the droplets having landed in the vicinity of the constriction part 250 from solidifying and the opening portion 250*a* from being blocked.

Figure 23:
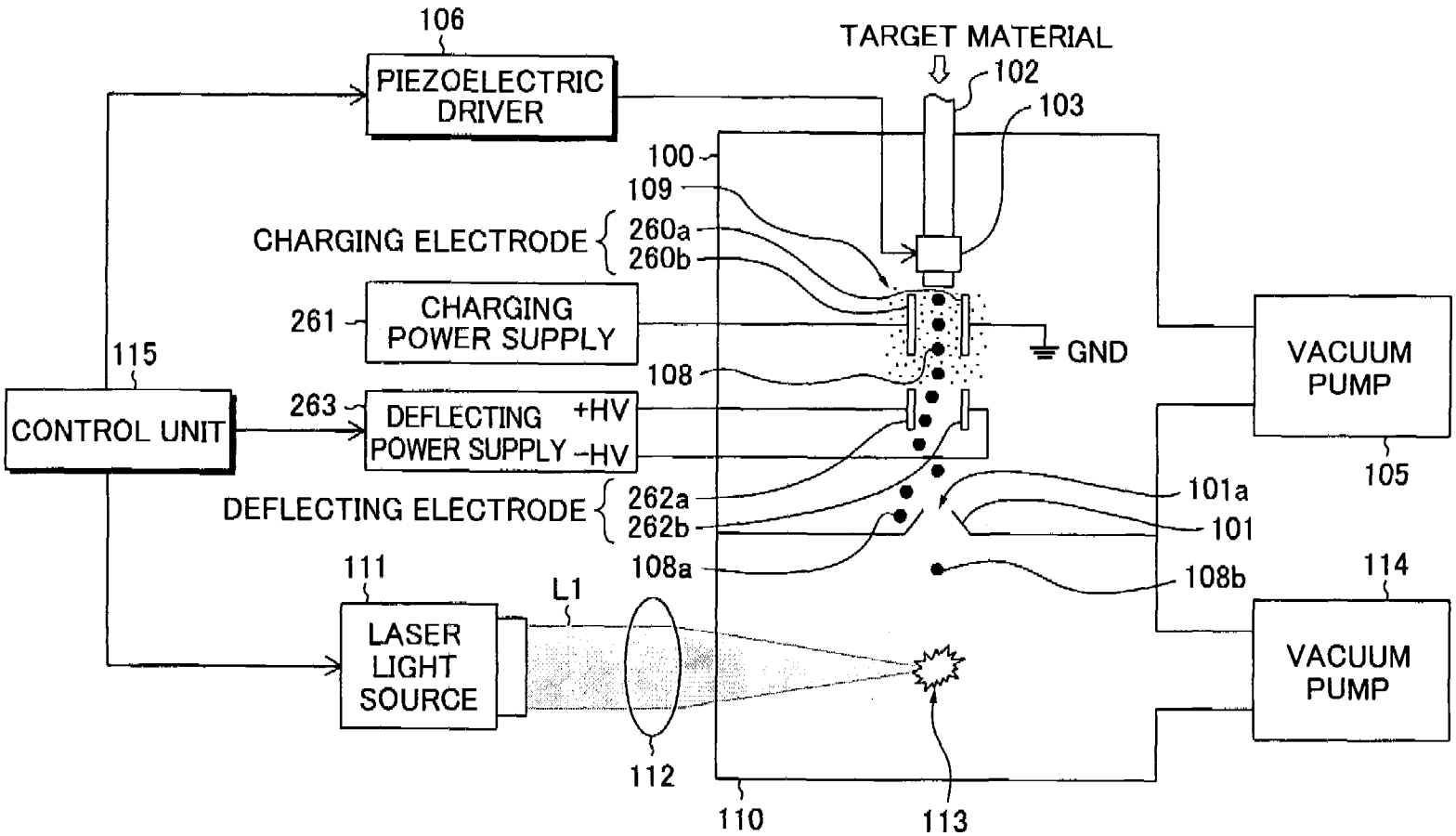
FIG. 23 is a schematic diagram showing a structure of the EUV light source device according to the fifteenth embodiment of the present invention.

FIG. 23 is a schematic diagram showing the structure of the EUV light source device according to a fifteenth embodiment of the present invention. In the EUV light source device, the droplet blocking unit 107 in the EUV light source device shown in FIG. 1 employs a structure in which two kinds of electrodes are used in order to change the orbit of the droplets. Other structure is the same as that shown in FIG. 1.

As shown in FIG. 23, this EUV light source device includes charging electrodes 260*a* and 260*b*, a charging power supply 261, deflecting electrodes 262*a* and 262*b*, and a deflecting power supply 263.

The charging electrodes 260*a* and 260*b* are arranged in the vicinity of the nozzle 102 in opposition to each other with the orbit of the droplets 108 that drops from the nozzle 102 being sandwiched in between. Further, the charging electrode 260*a* is connected to the ground wire and the charging electrode 260*b* is connected to the charging power supply 261. The droplets 108 having dropped from the nozzle 102 are supplied with charges to become charged by the charging power supply 261 via the charging electrodes 260*a* and 260*b* while passing through between the charging electrodes 260*a* and 260*b*.

The deflecting electrodes 262*a* and 262*b* are arranged in opposition to each other at downstream of the charging electrodes 260*a* and 260*b* with the orbit of the droplets 108 being sandwiched in between. Further, the deflecting electrode 262*a* is connected to the terminal of the positive high voltage terminal of the deflecting power supply 263 and the deflecting electrode 262*b* is connected to the negative high voltage terminal of the deflecting power supply 263. The deflecting power supply 263 is controlled by the control unit 115 and generates an electric filed between the electrodes 262*a* and 262*b* by applying a potential difference between the deflecting electrodes 262*a* and 262*b*.

The control unit 115 activates the deflecting power supply 263 when the droplets 108*a* charged by the charging electrodes 260*a* and 260*b* drop. Thereby, the droplets 108 deflect between the deflecting electrodes 262*a* and 262*b*, and therefore, their orbit shifts from the opening portion 101*a* and it is no longer possible for the droplets 108*a* to pass through the opening portion 101*a*. On the other hand, the control unit 115 deactivates the deflecting power supply 263 when the droplets 108*b* charged by the charging electrodes 260*a* and 260*b* drop. Thereby, the droplets 108*b* pass through the opening portion 101*a* without deflecting and are guided into the plasma generation chamber 110.

Here, the present embodiment is useful when a conductive target material is used in order to charge the droplets of the target material. As such a target material, for example, a molten metal such as melted stannum, lithium, or the like, mixture in which minute metal particles of stannum, copper, or the like are dispersed in water or alcohol, or ionic solution in which lithium fluoride (LiF) is dissolved into water can be used.

Figure 24:
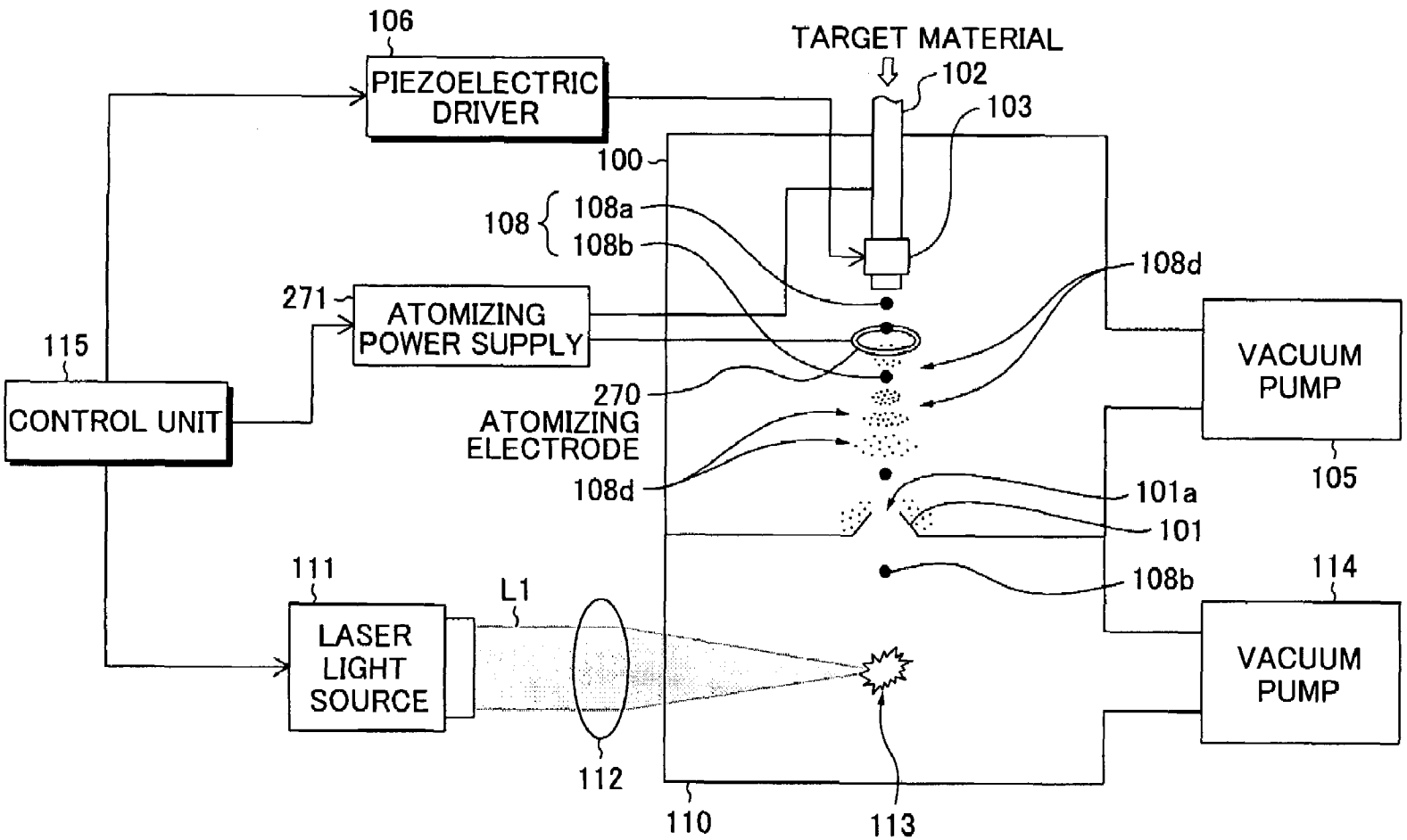
FIG. 24 is a schematic diagram showing a structure of the EUV light source device according to the sixteenth embodiment of the present invention.

FIG. 24 is a schematic diagram showing the structure of the EUV light source device according to a sixteenth embodiment of the present invention. In the EUV light source device, the droplet blocking unit 107 in the EUV light source device, shown in FIG. 1 employs a structure in which an electrode for atomizing droplets is used. Other structure is the same as that shown in FIG. 1.

As shown in FIG. 24, this EUV light source device includes a ring-shaped atomizing electrode 270 and an atomizing power supply 271. The atomizing electrode 270 is arranged such that the droplets 108 that drop from the nozzle 102 pass through the inside of the ring. The atomizing power supply 271 operates under the control of the control unit 115 and applies a potential difference to the droplets 108 that drop from the nozzle 102 by giving a potential difference between the atomizing electrode 270 and the nozzle 102.

The control unit 115 activates the atomizing power supply 271 when the droplets 108*a* are about to pass through the atomizing electrode 270. As a result, an excessive voltage is applied to the droplets 108*a* and the droplets 108 are broken and atomized. The minute particles 108*d* of the target material thus generated diffuse into the droplet generation chamber 100 and the majority of them are collected by the vacuum pump 105 without passing through the opening portion 101*a*. On the other hand, the control unit 115 deactivates the atomizing power supply 271 when the droplets 108*b* are about to pass through the atomizing power supply 270. As a result, the droplets 108*b* pass through the opening portion 101*a* without being atomized and are guided into the plasma generation chamber 110.

Incidentally, the present embodiment is also useful when a conductive target material, such as a molten metal such as melted stannum, lithium, or the like, mixture in which minute metal particles of stannum, copper, or the like are dispersed in water or alcohol, or ionic solution in which lithium fluoride (LiF) is dissolved into water, is used.

Figure 25:
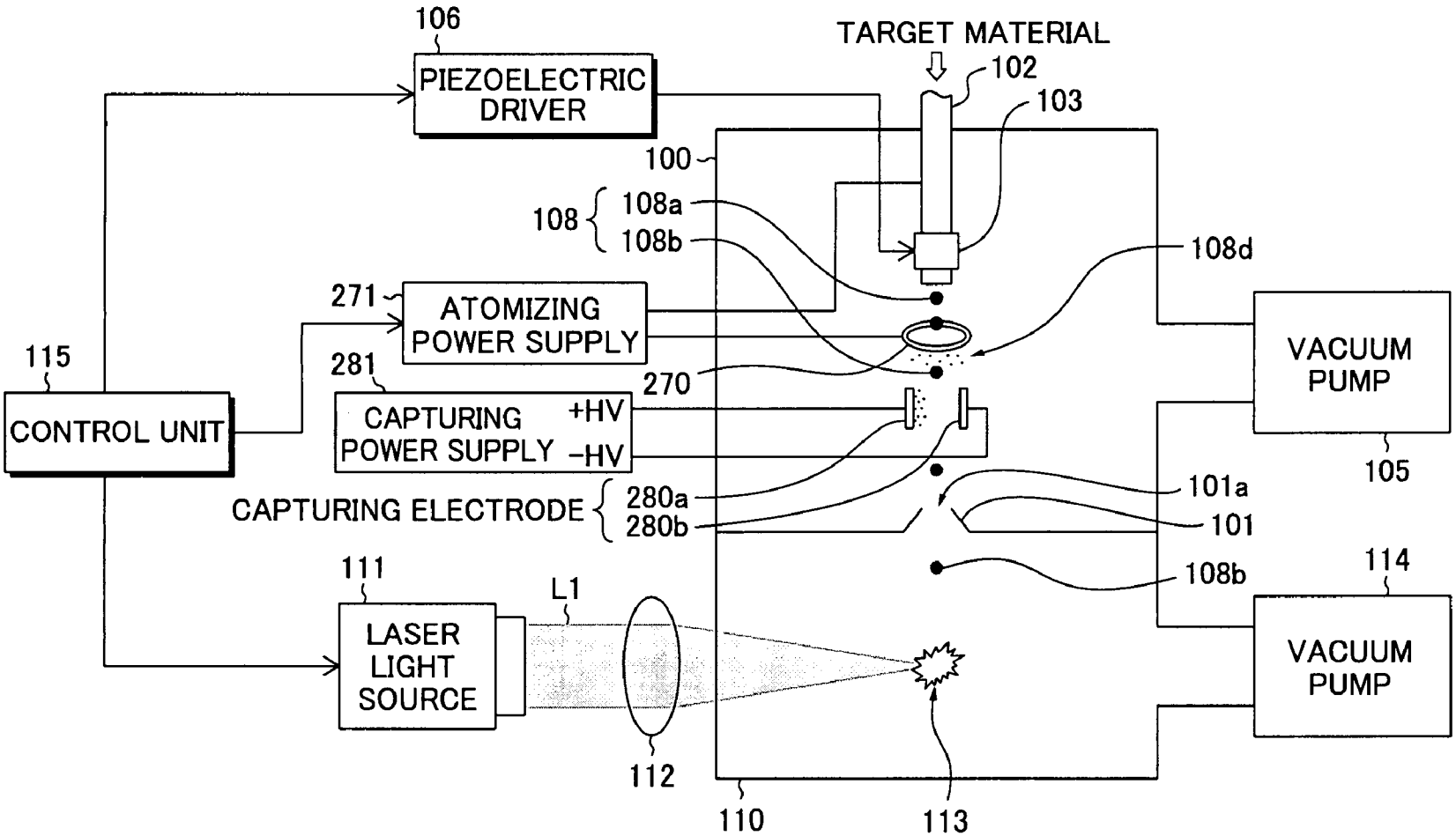
FIG. 25 is a schematic diagram showing a structure of the EUV light source device according to the seventeenth embodiment of the present invention.

FIG. 25 is a schematic diagram showing the structure of the EUV light source device according to a seventeenth embodiment of the present invention. The EUV light source device is further provided with capturing electrodes 280*a* and 280*b* for capturing atomized target materials and a capturing power supply 281 in addition to the components of the EUV light source device shown in FIG. 24. Other structure is the same as that shown in FIG. 24.

The capturing electrodes 280*a* and 280*b* are arranged at downstream of the atomizing electrode 270 in opposition to each other with the orbit of the droplets 108 being sandwiched in between. The capturing power supply 281 operates under the control of the control unit 115 and forms an electric field between the electrodes 280*a* and 280*b* by applying a potential difference between the capturing electrodes 280*a* and 280*b*.

Here, the minute particles 108*d* of the target material atomized when they pass through the inside of the ring of the atomizing electrode 270 are given charges in accordance with the applied voltage and the radius of the minute particles. The control unit 115 activates the capturing power supply 281 at the timing when the minute particles 108*d* of such a target material pass through the capturing electrodes 280*a* and 280*b*. As a result, the minute particles 108*d* of the target material are captured by the capturing electrode 280*a* or 280*b*. On the other hand, the control unit 115 deactivates the capturing power supply 281 when the droplets 108*b* are about to pass through between the capturing electrodes 280*a* and 280*b*. As a result, the droplets 108*b* pass through the opening portion 101*a* without being captured by the electrode and are guided into the plasma generation chamber 110.

Incidentally, the present embodiment is also useful when a conductive target material, such as a molten metal such as melted tin, lithium, or the like, a mixture in which minute metal particles of stannum, copper, or the like are dispersed in water or alcohol, or an ionic solution in which lithium fluoride (LiF) is dissolved into water, is used.

According to the present embodiment, since the majority of the atomized target materials are captured by the capturing electrodes 280*a* and 280*b*, it is possible to drastically reduce the amount of target material flowing into the plasma generation chamber 110 through the opening portion 101*a*.

Also in the fifteenth to seventeenth embodiments of the present invention described above, similar to that shown in FIG. 21, it may also be possible to provide a heater in the vicinity of the constriction part 101 or 250. Thereby, it is possible to prevent the droplets 108*a* having landed in the vicinity of the constriction part 101 and their minute particles from solidifying and the opening portion 101*a* from being blocked.

Figure 26:
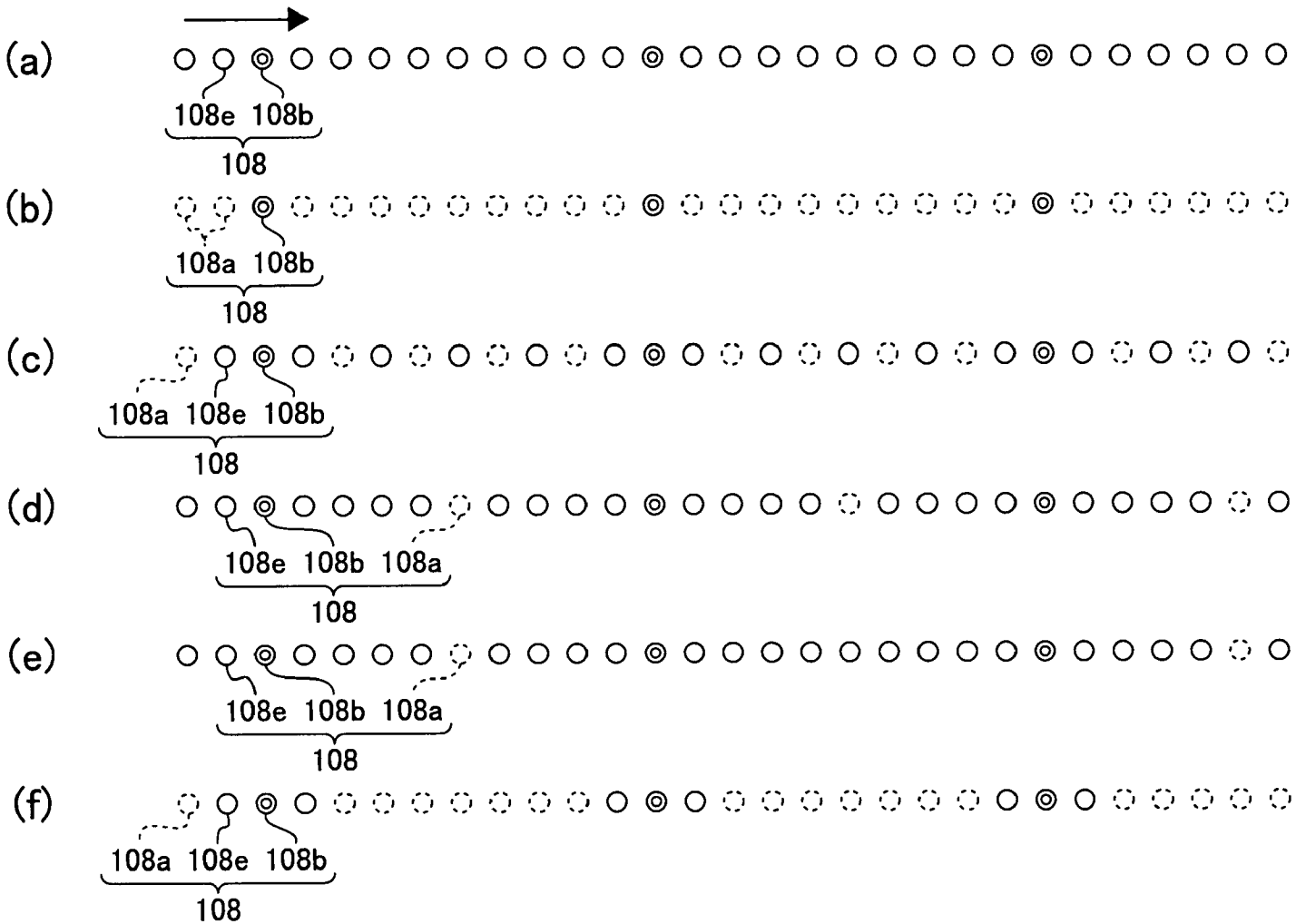
FIG. 26 is a diagram for explaining thinning out of droplets injected from a nozzle.

FIG. 26 is a diagram for explaining thinning out of the droplets 108 injected from the nozzle in the first to seventeenth embodiments of the present invention. In FIG. 26 (*a*) to (*f*), it is assumed that the generation frequency of droplets is 100 kHz, the repetitive operation frequency of the laser beam is 10 kHz, and one of ten generated droplets is irradiated with the laser beam. In FIG. 26 (*a*) to (*f*), a double circle indicates the droplet 108*b* to be irradiated with the laser beam in the plasma generation chamber among the generated droplets 108, a dotted circle indicates the droplet 108*a* to be thinned out because it is not to be irradiated with the laser beam, and a circle indicates the droplet 108*e* not to be irradiated with the laser beam but not thinned out. In addition, the arrow indicates the advancing direction of the droplet 108.

FIG. 26 (*a*) shows a laser irradiation method in the conventional EUV light source device for reference. Conventionally, the droplets are not thinned out, and therefore, unwanted droplets 108*e* are guided into the plasma generation chamber 110 (FIG. 1), forming a factor to reduce a degree of vacuum or cleanness.

FIG. 26 (*b*) shows an example in which all the droplets except for the droplets 108*b* to be irradiated with the laser beam are thinned out. According to this example, since the unwanted droplets that pass through the opening portion 101*a* can be kept to a minimum, it is made possible to maintain the degree of vacuum or cleanness in the plasma generation chamber 110 at highest. In this case, it is possible to increase the degree of vacuum or cleanness in the plasma generation chamber 110 to become about ten times as compared to that in the case shown in FIG. 26 (*a*).

FIG. 26 (*c*) to (*e*) show examples in which droplets other than the droplets 108*b* irradiated with the laser beam are thinned out intermittently. It is possible to cause the droplet blocking unit to operate stably and to lengthen the life of the droplet blocking unit by thus adjusting the drive frequency in accordance with the structure and the operation of the droplet blocking unit. For example, as shown in FIG. 26 (*c*), it is possible to thin out every other unwanted droplet by driving the droplet blocking unit 107 (FIG. 1) at 50 kHz. In this case, it is possible to increase the degree of vacuum or cleanness in the plasma generation chamber 110 to become approximately twice as compared to that in the case shown in FIG. 26 (*a*). Further, as shown in FIG. 26 (*d*), it is possible to increase the degree of vacuum or cleanness in the plasma generation chamber 110 to become about 1.1 times as compared to that in the case shown in FIG. 26 (*a*) by driving the droplet blocking unit 107 at 10 kHz. Furthermore, as shown in FIG. 26 (*e*), it is possible to increase the degree of vacuum or cleanness in the plasma generation chamber 110 to become about 1.05 times as compared to that in the case shown in FIG. 26 (*a*) by driving the droplet blocking unit 107 at 5 kHz.

FIG. 26 (*f*) shows an example in which the droplets 108*e* preceding or succeeding the droplet 108*b* are left and other droplets 108*a* are thinned out. Here, if a certain droplet is broken by the droplet blocking unit 107, there is a possibility of occurrence of an event in which the droplets existing therearound are influenced and broken, deformed, or changed in their orbit. Because of this, in FIG. 26 (*f*), in order for the droplet 108*b* to be irradiated with the laser beam is not influenced as described above, the droplets 108*e* preceding or succeeding the droplet are left. The number of droplets 108*e* to be left may be one or more for each of a portion preceding and a portion succeeding the droplet 108*b* to be irradiated with the laser beam. It is desirable to select the number of droplets in a range that can increase the degree of vacuum or cleanness in the plasma generation chamber 110 compared to that in the case shown in FIG. 26 (*a*) while taking into account the influence of the broken droplets imposed on the neighboring droplets in accordance with the structure and the breaking power of the droplet blocking unit 107 to be used.

FIGS. 27 to 30 are diagrams for explaining a method of controlling the drive timing of the droplet blocking unit, specifically showing the structure of the control unit 115 (FIG. 1 to FIG. 25) in the first to seventeenth embodiments of the present invention.

Figure 27:
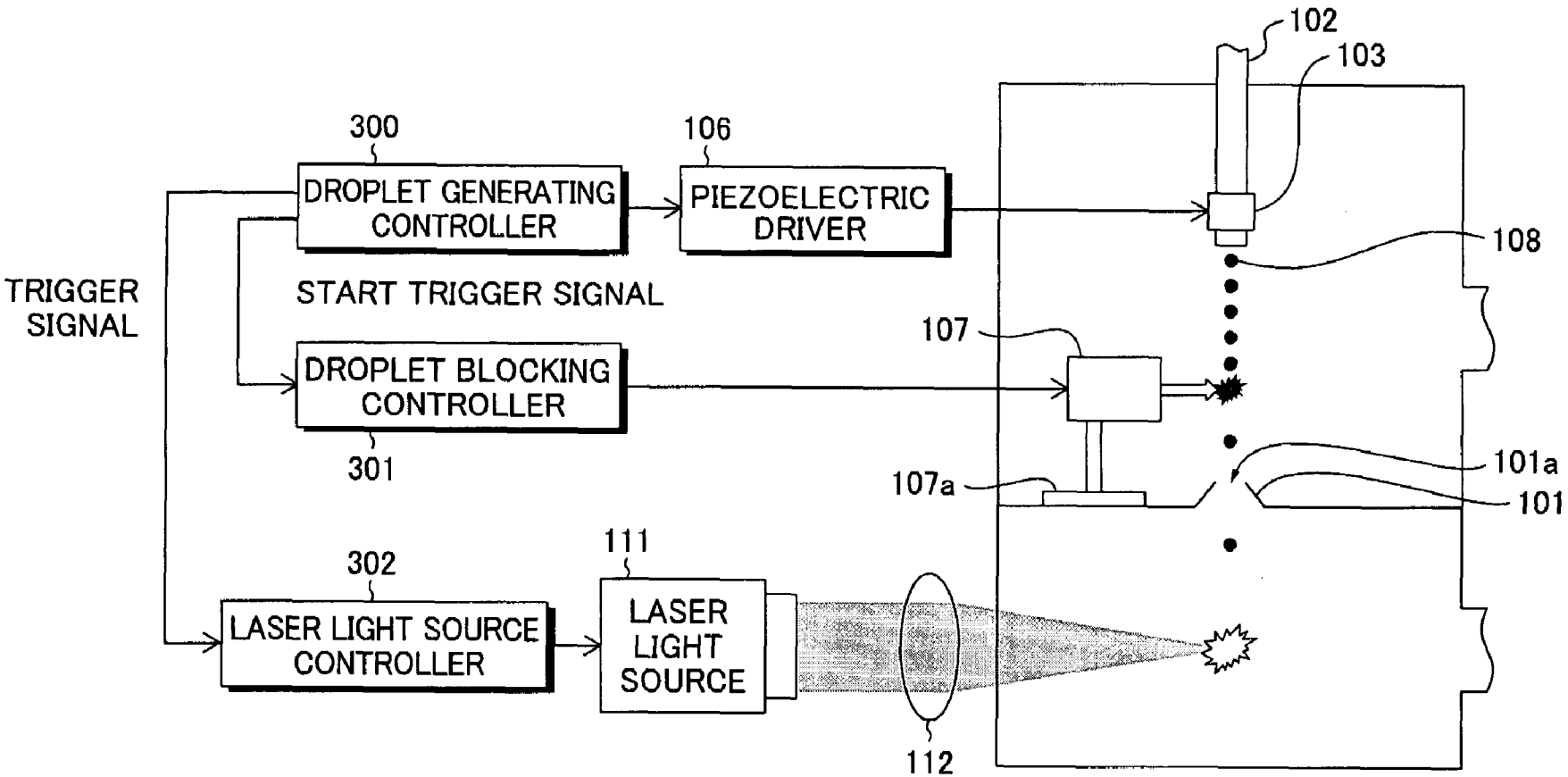
FIG. 27 is a diagram for explaining a first method of controlling a driving timing of a droplet blocking unit.

FIG. 27 shows a droplet generating controller 300 for controlling the piezoelectric driver 106 that generates a drive signal to be supplied to the piezoelectric element 103 in order to generate droplets, a droplet blocking controller 301 for controlling the droplet blocking unit 107, and a laser light source controller 302 for controlling the laser light source that emits a laser beam for irradiating a target material. The droplet generating controller 300, for example, controls the piezoelectric driver 106 such that a drive signal is generated at 100 kHz. Further, the laser light source controller 302 controls the laser light source 111 in synchronization with a trigger signal supplied from the droplet generating controller in order to emit the laser beam at a repetitive operation frequency of, for example, 10 kHz. Furthermore, in the droplet blocking controller 301, the drive frequency at which the droplet blocking unit is activated, the duration of the operation time, the operation period, the operation strength, and so on are programmed in advance.

In such a device, the droplet generating controller 300 supplies a start trigger signal to the droplet blocking controller 301 at the same time of starting its own operation. Thereby, the droplet blocking controller 301 starts the operation programmed in advance. For example, it is possible to perform the operation explained by referring FIG. 26 (*c*) by programming the use of a drive frequency of 50 kHz in the droplet blocking controller 301. Thus, it is possible to constitute a control system simply and at a low cost by synchronizing the operation of the controllers 300 to 302 by using the trigger signal.

Figure 28:
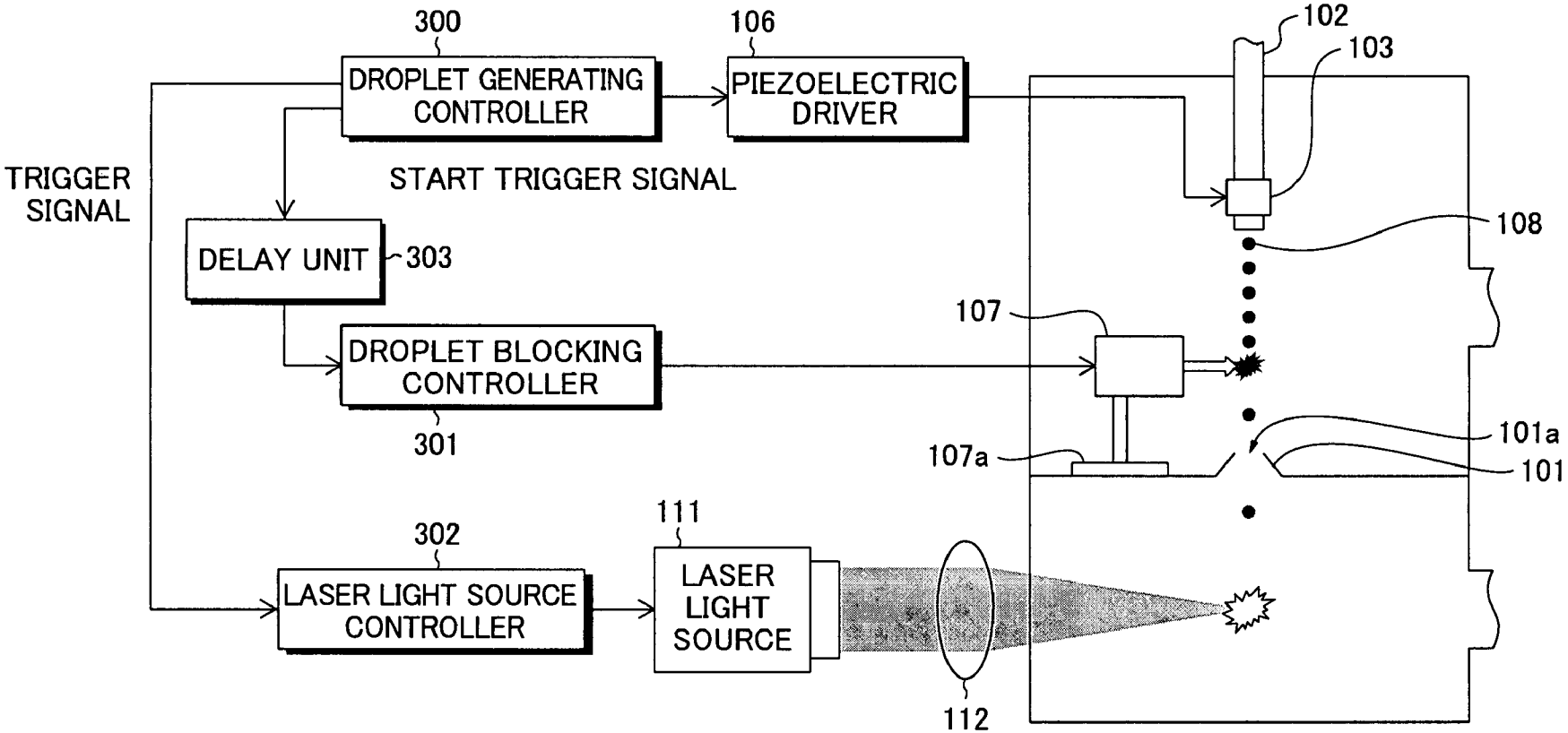
FIG. 28 is a diagram for explaining a second method of controlling a driving timing of a droplet blocking unit.

The structure shown in FIG. 28 is further provided with a delay unit 303 between the droplet generating controller 300 and the droplet blocking controller 301 in addition to the structure shown in FIG. 27. The delay unit 303 adjusts the operation timing between these controllers 300 and 301 by giving a proper delay to the start trigger signal output from the droplet generating controller 300 and supplying it to the droplet blocking controller 301.

Here, for example, when droplets having a flow rate of 25 m/s and a generation frequency of 100 kHz are generated, in the columns of droplets that drop from the nozzle 102, the distance between neighboring droplets is about 250 μm and the time interval is about 10 μs. Because of this, depending on the distance between the nozzle 102 and the droplet blocking unit 107, there may be the case where the timing at which the droplets 108 pass through at the height of the droplet blocking unit 107 shifts from the operation timing of the droplet blocking unit 107. Consequently, by adjusting in advance the transmission timing of the start trigger signal by the delay unit 303, it is possible to thin out without fail the unwanted droplets 108 by the droplet blocking unit 107. The adjustment of the delay unit 303 can also be performed manually. Alternatively, it may also be possible to adjust the delay time from the activation of the start trigger signal to the operation start timing in the droplet blocking controller 301 instead of the provision of the delay unit 303.

Figure 29:
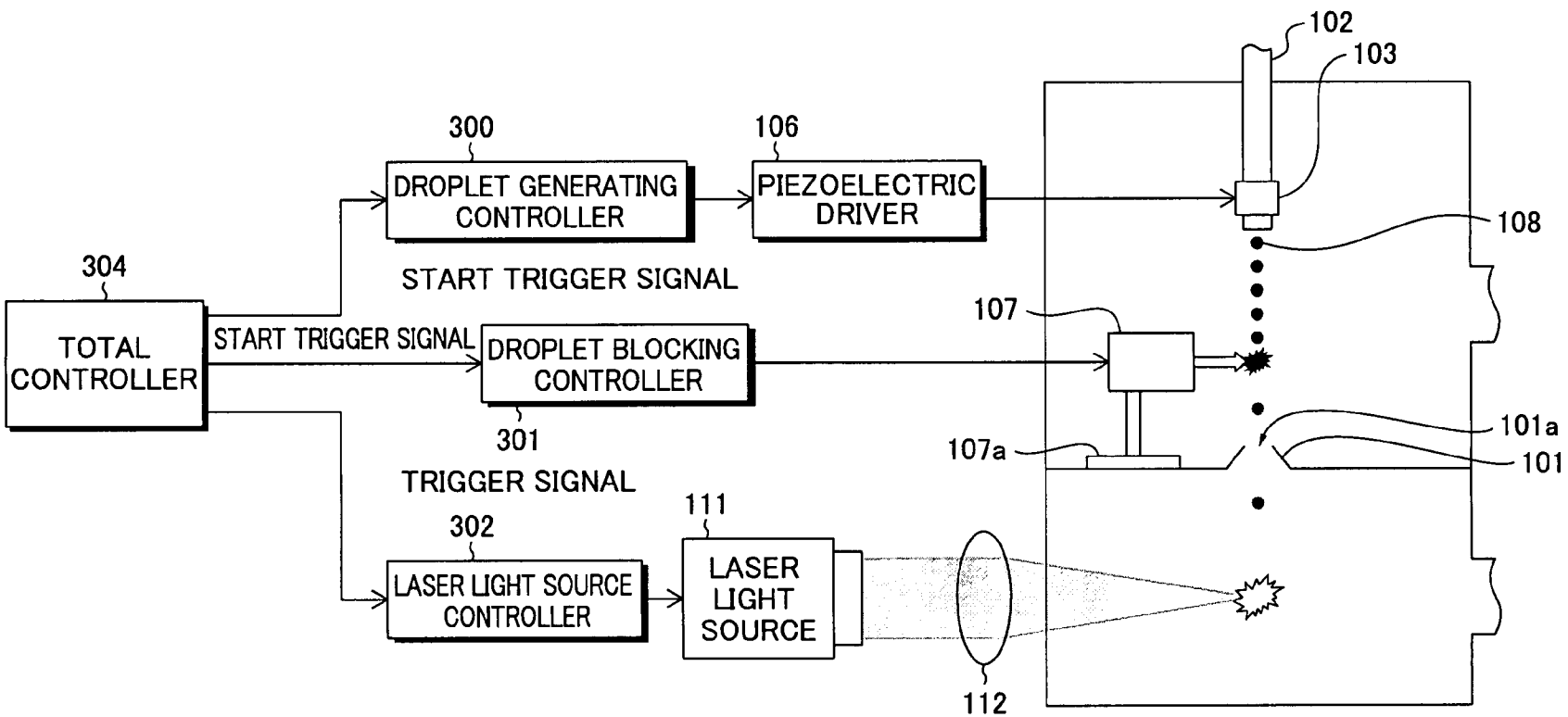
FIG. 29 is diagram for explaining a third method of controlling a driving timing of a droplet blocking unit.

The structure shown in FIG. 29 is further provided with a total controller that controls the droplet generating controller 300, the droplet blocking controller 301, and the laser controller 302 in addition to the structure shown in FIG. 27.

In FIG. 29, the total controller 304 supplies the start trigger signal to the droplet generating controller 300 and the droplet blocking controller 301 and supplies the trigger signal to the laser controller 302. Thereby, the droplet generating controller 300 starts the generation of droplets at a set generation frequency and the droplet blocking controller 301 starts the operation in accordance with the drive frequency, the duration of the operation time, the operation period, the operation strength, etc., programmed in advance. Further, the laser controller 302 causes the laser light source 111 to produce laser oscillation at a predetermined repetitive operation frequency.

Figure 30:
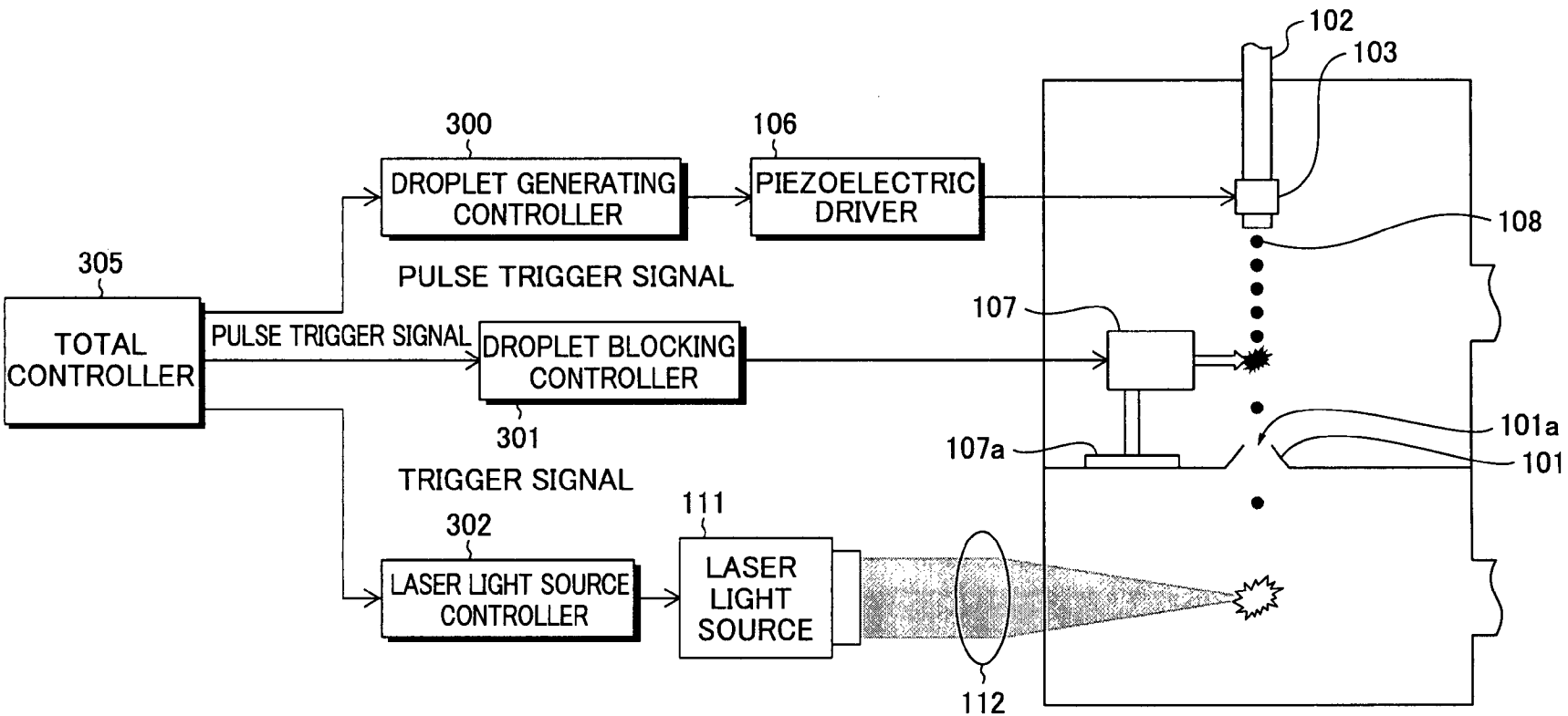
FIG. 30 is a diagram for explaining a fourth method of controlling a driving timing of a droplet blocking unit.
Figure 31:
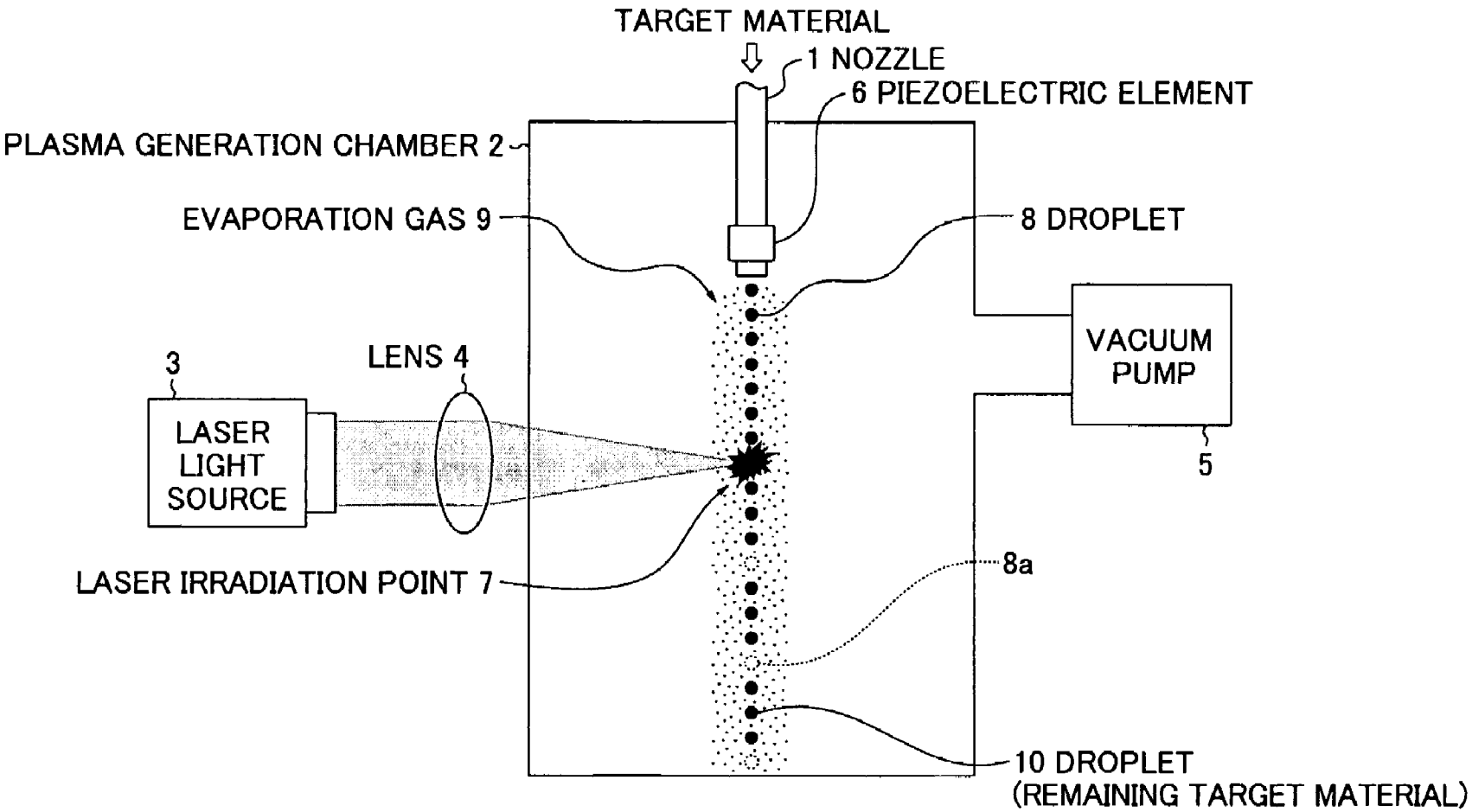
FIG.31 PRIOR ART
FIG. 31 is a schematic diagram showing structure of a conventional LPP type EUV light source device.
Figure 32:
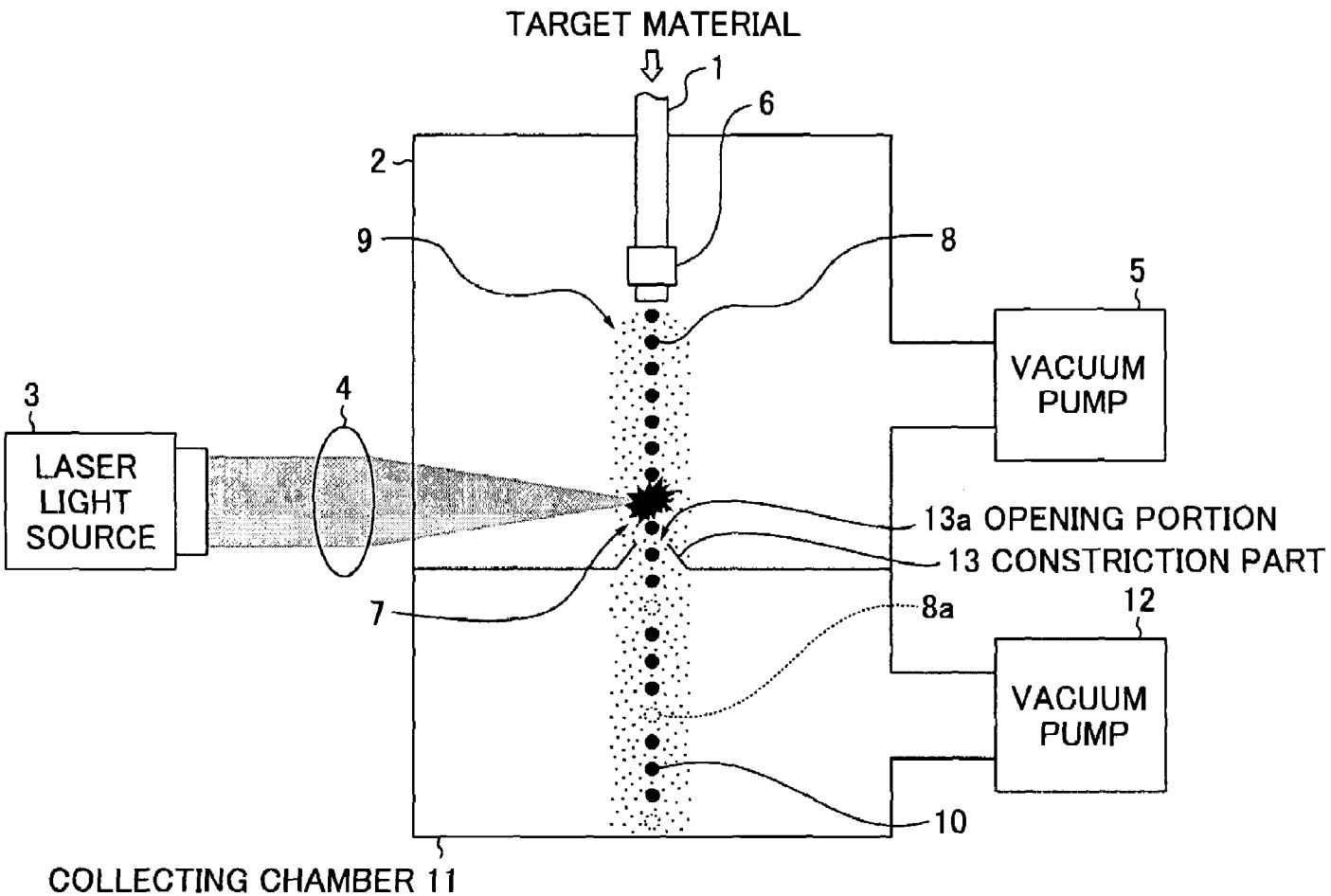
FIG.32 PRIOR ART
FIG. 32 is a schematic diagram showing an example in which a droplet collecting chamber is provided in the LPP type EUV light source device.
Figure 33:
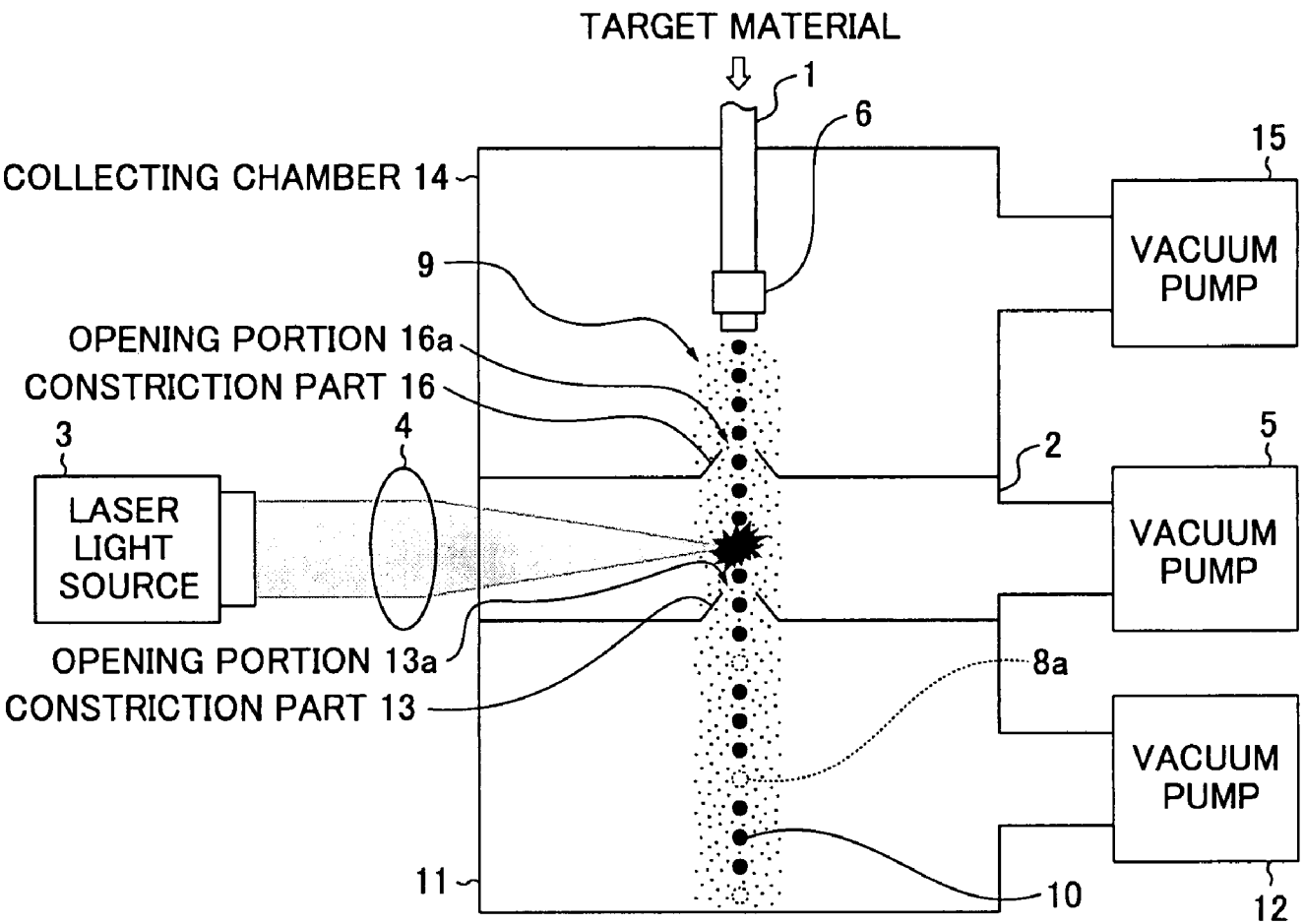
FIG.33 PRIOR ART
FIG. 33 is a schematic diagram showing an example in which a second droplet collecting chamber is provided in the LPP type EUV light source device.

The structure shown in FIG. 30 is provided with a total controller 305 instead of the total controller 304 shown in FIG. 29. In the total controller 305, the generation frequency of the droplets 108, the drive frequency of the droplet blocking unit 107, the duration of the operation time, the operation period, the operation strength, etc., are programmed. The total controller 305 supplies the pulse trigger signal in accordance with the generation frequency (for example, 100 kHz) to the droplet generating controller 300, supplies the pulse trigger signal in accordance with the drive frequency (for example, 50 kHz) to the droplet blocking controller 301, and supplies the pulse trigger signal in accordance with the repetitive operation frequency (for example, 10 kHz) to the laser light source controller 302. In response to this, the droplet generating controller 300 operates once when the pulse trigger signal is supplied, the droplet blocking controller 301 operates once when the pulse trigger signal is supplied, and the laser light source controller 302 operates once when the pulse trigger signal is supplied.

In FIG. 29 or FIG. 30, in the case where there is a possibility of the occurrence of a shift between the passing timing of the droplets 108 and the operation timing of the droplet blocking unit 107, in order to eliminate the shift, it may also be possible to supply the start trigger signal by providing a predetermined time difference from the total controller 304 or 305 to the droplet generating controller 300 and the droplet blocking controller 301. Alternatively, it may also be possible to provide a delay unit between the total controller 304 or 305 and the droplet blocking controller 301, or to adjust a delay time from the activation of the start trigger signal to the operation start timing in the droplet blocking controller 301.

The invention claimed is:

1. An extreme ultra violet light source device for generating extreme ultra violet light by irradiating a target material with a laser beam emitted from a laser light source to turn the target material into a plasma state, said device comprising:

a first chamber;

a second chamber connected to said first chamber through an opening portion;

a target supplier that supplies a target material into said first chamber;

droplet generating means provided in said first chamber, said droplet generating means generating droplets of the target material of molten metal such that the droplets repetitively drop based on the target material supplied by said target supplier;

blocking means that prevents the droplets of the target material generated by said droplet generating means from passing through said opening portion;

control means that controls said blocking means to operate at predetermined timing;

a laser light source that generates a laser beam; and an optical system that leads the laser beam generated by said laser light source to the droplets of the target material generated in said first chamber and introduced into said second chamber through said opening portion.

2. The extreme ultra violet light source device according to claim 1, wherein:

said target supplier includes a nozzle for injecting the target material; and said droplet generating means includes means for adding vibration at a predetermined frequency to the target material injected from said nozzle.

3. The extreme ultra violet light source device according to claim 1, wherein said blocking means breaks the droplets of the target material.

4. The extreme ultra violet light source device according to claim 3, further comprising:

collecting means that collects the droplets of the target material broken by said blocking means.

5. The extreme ultra violet light source device according to claim 1, wherein said blocking means includes:

charge supplier that charges the droplets of the target material; and electric field forming means that forms an electric field for deflecting the charged droplets.

6. The extreme ultra violet light source device according to claim 5, wherein said charge supplier includes plasma generating means that generates plasma.

7. The extreme ultra violet light source device according to claim 5, wherein said charge supplier includes electron beam generating means that generates electron beams.

8. The extreme ultra violet light source device according to claim 1, wherein said blocking means includes atomizing means that breaks the droplets of the target material into minute particles by applying a voltage to the droplets.

9. The extreme ultra violet light source device according to claim 8, further comprising:

capturing means that forms an electric field for capturing the minute particles of the target material.

10. The extreme ultra violet light source device according to claim 1, further comprising:

heating means that heats surroundings of said opening portion.

11. The extreme ultra violet light source device according to claim 1, wherein said controlling means controls operation timing of said blocking means based on a generation frequency of the droplets generated by said droplet generating means and a repetitive operation frequency of said laser light source.

12. An extreme ultra violet light source device for generating extreme ultra violet light by irradiating a target material with a laser beam emitted from a laser light source to turn the target material into a plasma state, said device comprising:

a first chamber;

a second chamber connected to said first chamber through an opening portion;

a target supplier that supplies a target material into said first chamber;

droplet generating means provided in said first chamber, said droplet generating means generating droplets of the target material of molten metal such that the droplets repetitively drop based on the target material supplied by said target supplier;

blocking means that prevents the droplets of the target material generated by said droplet generating means from passing through said opening portion, said blocking means including a blocking member to be inserted into a path of the droplets of the target material, and displacing means that changes at least one of a position and an angle of said blocking member;

heating means provided at said blocking member, said heating means heating said blocking member;

control means that controls said blocking means to operate at predetermined timing;

a laser light source that generates a laser beam; and an optical system that leads the laser beam generated by said laser light source to the droplets of the target material generated in said first chamber and introduced into said second chamber through said opening portion.

13. The extreme ultra violet light source device according to claim 12, wherein said displacing means includes a piezoelectric element provided to said blocking member.

14. The extreme ultra violet light source device according to claim 12, wherein said displacing means includes a motor provided to said blocking member.

15. The extreme ultra violet light source device according to claim 12, wherein said blocking member has one of a bar-like shape, a plate-like shape, and a disc-like shape.

16. The extreme ultra violet light source device according to claim 12, wherein said blocking means blocks said opening portion from the droplets of the target material.

17. An extreme ultra violet light source device for generating extreme ultra violet light by irradiating a target material with a laser beam emitted from a laser light source to turn the target material into a plasma state, said device comprising:

a first chamber;

a second chamber connected to said first chamber through an opening portion;

a target supplier that supplies a target material into said first chamber;

droplet generating means provided in said first chamber, said droplet generating means generating droplets of the target material of molten metal such that the droplets repetitively drop based on the target material supplied by said target supplier;

blocking means that emits a laser beam for irradiating the droplets of the target material generated by said droplet generating means, and propagates the laser beam into a path of the droplets of the target material in said first chamber to prevent the droplets of the target material from passing though said opening portion;

control means that controls said blocking means to operate at predetermined timing;

a laser light source that generates a laser beam; and an optical system that leads the laser beam generated by said laser light source to the droplets of the target material generated in said first chamber and introduced into said second chamber through said opening portion.

18. An extreme ultra violet light source device for generating extreme ultra violet light by irradiating a target material with a laser beam emitted from a laser light source to turn the target material into a plasma state, said device comprising:

a first chamber;

a second chamber connected to said first chamber through an opening portion;

a target supplier that supplies a target material into said first chamber;

droplet generating means provided in said first chamber, said droplet generating means generating droplets of the target material of molten metal such that the droplets repetitively drop based on the target material supplied by said target supplier;

blocking means that prevents the droplets of the target material generated by said droplet generating means from passing through said opening portion;

control means that controls said blocking means to operate at predetermined timing;

a laser light source that generates a laser beam; and an optical system that leads the laser beam generated by said laser light source to the droplets of the target material generated in said first chamber and introduced into said second chamber through said opening portion, wherein said blocking means includes:

(i) a nozzle for injecting a high pressure gas to be sprayed to the droplets of the target material;

(ii) a gas supplier that supplies the high pressure gas to said nozzle; and (iii) shutter means that blocks the high pressure gas injected from said nozzle from the droplets of the target material.

19. The extreme ultra violet light source device according to claim 18, wherein said blocking means changes a path of the droplets of the target material.

20. The extreme ultra violet light source device according to claim 19, further comprising:

collecting means that collects the droplets of the target material the path of which is changed by said blocking means.

21. An extreme ultra violet light source device for generating extreme ultra violet light by irradiating a target material with a laser beam emitted from a laser light source to turn the target material into a plasma state, said device comprising:

a first chamber:

a second chamber connected to said first chamber through an opening portion;

a target supplier that supplies a target material into said first chamber, said target supplier including a nozzle for injecting the target material;

droplet generating means provided in said first chamber, said droplet generating means generating droplets of the target material of molten metal such that the droplets repetitively drop based on the target material supplied by said target supplier;

blocking means that causes a path of the droplets of the target material injected from said nozzle to shift from said opening portion by changing one of a position and an angle of said nozzle to prevent the droplets of the target material from passing through said opening portion;

control means that controls said blocking means to operate at predetermined timing;

a laser light source that generates a laser beam; and an optical system that leads the laser beam generated by said laser light source to the droplets of the target material generated in said first chamber and introduced into said second chamber through said opening portion.

22. The extreme ultra violet light source device according to claim 21, wherein said blocking means includes:

a piezoelectric element provided to said nozzle; and drive signal generating means that generates a drive signal to be supplied to said piezoelectric element.

23. An extreme ultra violet light source device for generating extreme ultra violet light by irradiating a target material with a laser beam emitted from a laser light source to turn the target material into a plasma state, said device comprising:

a first chamber;

a second chamber connected to said first chamber through an opening portion;

a target supplier that supplies a target material into said first chamber;

droplet generating means provided in said first chamber said droplet generating means generating droplets of the target material of molten metal such that the droplets repetitively drop based on the target material supplied by said target supplier;

blocking means that prevents the droplets of the target material generated by said droplet generating means from passing through said opening portion:

control means that controls said blocking means to operate at predetermined timing;

a laser light source that generates a laser beam; and an optical system that leads the laser beam generated by said laser light source to the droplets of the target material generated in said first chamber and introduced into said second chamber through said opening portion, wherein said first chamber and said second chamber are connected via an opening portion provided to a deformable member, and said blocking means includes deforming means that deforms said deformable member such that said opening portion is shifted from a path of the droplets of the target material.

24. The extreme ultra violet light source device according to claim 23, wherein said deforming means includes:

a piezoelectric element provided to said member; and drive signal generating means that generates a drive signal to be supplied to said piezoelectric element.

* * * * *